US011326593B2

(12) United States Patent
Gossen

(10) Patent No.: US 11,326,593 B2
(45) Date of Patent: May 10, 2022

(54) SCROLL COMPRESSOR ORBITAL PATH BALANCING MASS

(71) Applicant: BITZER Kuehlmaschinenbau GmbH, Sindelfingen (DE)

(72) Inventor: Dimitri Gossen, Altdorf (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 253 days.

(21) Appl. No.: 16/257,743

(22) Filed: Jan. 25, 2019

(65) Prior Publication Data

US 2019/0170139 A1 Jun. 6, 2019

Related U.S. Application Data

(63) Continuation of application No. PCT/EP2016/067943, filed on Jul. 27, 2016.

(51) Int. Cl.

| | |
|---|---|
| ***F04C 2/02*** | (2006.01) |
| ***F04C 29/00*** | (2006.01) |
| ***F04C 18/02*** | (2006.01) |

(52) U.S. Cl.

CPC ..... *F04C 2/025* (2013.01); *F04C 18/0215* (2013.01); *F04C 29/0057* (2013.01); *F04C 2240/807* (2013.01)

(58) Field of Classification Search

CPC ..... F04C 18/0215; F04C 2240/807; F04C 29/0057; F04C 2/025

See application file for complete search history.

(56) References Cited

U.S. PATENT DOCUMENTS 4,824,346 A * 4/1989 Hiraga ..... F01C 1/0215 418/151
5,366,357 A * 11/1994 Fukanuma ..... F04C 29/0021 418/151

(Continued)

FOREIGN PATENT DOCUMENTS

| | | |
|---|---|---|
| EP | 0 924 432 A1 | 6/1999 |
| JP | S59 126096 A | 7/1984 |
| JP | S61 250393 A | 11/1986 |

OTHER PUBLICATIONS

Machine Translation of JP-59-126096, Inventor: Suzuki et al.; Title: Rotary Scroll Member Driving Mechanism in Scroll Type Compressor, Published on Jul. 20, 1984. (Year: 1984).*

*Primary Examiner* — Mary Davis
(74) *Attorney, Agent, or Firm* — Reinhart Boerner Van Deuren P.C.

(57) ABSTRACT

In order to improve a compressor comprising a compressor housing, a scroll compressor unit which is arranged in the compressor housing and comprises a first stationary compressor body and a second compressor body that can be moved relative to the stationary compressor body, an eccentric drive for the scroll compressor unit, said drive having a drive member which is driven by a drive motor and which revolves about the central axis of a driveshaft on an orbital path, and an orbital path balancing mass which counteracts an unbalance due to the compressor body moving on the orbital path, so that even at high rotational speeds the long-term stability of the drive member guidance in the drive member receptacle can be ensured, it is proposed that the orbital path balancing mass is coupled to the eccentric drive such that the mass moves on the orbital path in a manner corresponding to the movement of the drive member but is uncoupled with respect to the transmission of tilting moments to the drive member.

38 Claims, 18 Drawing Sheets

(56) References Cited

U.S. PATENT DOCUMENTS 5,366,360 A 11/1994 Bookbinder et al.
5,681,155 A * 10/1997 Hisanaga ..... F04C 29/0057
418/14

* cited by examiner

SCROLL COMPRESSOR ORBITAL PATH BALANCING MASS

CROSS-REFERENCE TO RELATED PATENT APPLICATION

This application is a continuation of International application number PCT/EP2016/067943 filed on Jul. 27, 2016.

This patent application claims the benefit of International application No. PCT/EP2016/067943 of Jul. 27, 2016 the teachings and disclosure of which are hereby incorporated in their entirety by reference thereto.

BACKGROUND OF THE INVENTION

The invention relates to a compressor, comprising a compressor housing, a scroll compressor unit which is arranged in the compressor housing and comprises a first stationary compressor body and a second compressor body movable relative to the stationary compressor body, the first and second scroll ribs of which, which are each formed as an involute of a circle, engage in one another and form compressor chambers when the second compressor body is moved relative to the first compressor body on an orbital path, an axial guide which supports the movable compressor body in respect of movements in a direction parallel to a central axis of the stationary compressor body and guides the movable compressor body in the event of movements in a direction transverse to the central axis, an eccentric drive for the scroll compressor unit, said drive having a drive member which is driven by a drive motor and which revolves about the central axis of a driveshaft on the orbital path and which for its part cooperates with a drive member receptacle of the second compressor body, an orbital path balancing mass which counteracts an unbalance due to the compressor body moving on the orbital path, and a coupling preventing the second compressor body from rotating by itself.

Compressors of this kind are known from the prior art.

A drive motor for a compressor of this kind can be operated with variable rotational speed, for example by means of a converter, or can be operated at a constant rotational speed.

In these compressors there is the problem—in particular at high rotational speeds, which for example can be over 6,000 revolutions per minute—that the guidance of the drive member in the drive member receptacle has low long-term stability, in particular if a rolling element bearing, for example a cylindrical roller bearing, is provided in the drive member receptacle for mounting of the drive member.

The object of the invention is therefore to improve a compressor of the above general type in such a way that, even at high rotational speeds, the long-term stability of the guidance of the drive member in the drive member receptacle can be ensured.

SUMMARY OF THE INVENTION

In accordance with the invention, this object is achieved in a compressor of the kind described at the outset in that the orbital path balancing mass is coupled to the eccentric drive such that said mass moves on the orbital path in a manner corresponding to the movement of the drive member but is uncoupled with respect to the transmission of tilting moments to the drive member.

The solution according to the invention is thus based on the finding, which was not known from the prior art, that in the known solutions with a rigid connection of the drive member and orbital path balancing mass, at the high rotational speeds, the orbital path balancing mass acts on the drive member with high tilting moments and therefore the mounting of the drive member in the drive member receptacle, in particular when this is achieved by a rolling element bearing, for example a cylindrical roller bearing, is exposed to a high level of wear, since bearings of this kind are exposed to increased wear in situations in which tilting moments occur.

The problem encountered in the known solutions of the orbital path balancing mass acting on the drive member with tilting moments is now solved with the solution according to the invention by uncoupling the drive member from the orbital path balancing mass in such a way that said mass can no longer act on the drive member with considerable tilting moments.

With regard to the guidance of the orbital path balancing mass, no further details have as yet been provided.

In principle, it would be conceivable to mount and to guide the orbital path balancing mass relative to the driveshaft by a bearing element provided on the driveshaft.

A particularly simple solution of favorable construction provides that the orbital path balancing mass is guided on the orbital path by an eccentric drive journal acting between the drive member and the driveshaft.

This solution has the great advantage that the eccentric drive journal which is provided anyway and which is effective between the drive member and the driveshaft can be used to guide the orbital path balancing mass such that said mass follows the orbital path of the drive member, so as to bring about the necessary mass balancing on account of the eccentricity of the orbital path of the drive member on the driveshaft without any transmission of tilting moments from the orbital path balancing mass to the drive member.

Alternatively or additionally, the object stated at the outset is also achieved in accordance with the invention in that the orbital path balancing mass engages with the eccentric drive journal, in particular is mounted rotatably thereon, by means of a guide body.

In this case a particularly simple connection can be produced between the orbital path balancing mass and the eccentric drive journal.

To this end, the guide body is preferably fixedly connected to the orbital path balancing mass.

It is particularly favorable if the eccentric drive journal passes through a journal receptacle in the guide body.

A solution that is particularly favorable in terms of its construction provides that the orbital path balancing mass is guided on the driveshaft by means of a guide body cooperating with the driveshaft.

This solution creates an additional reduction of the load on the eccentric drive journal since an additional guidance of the guide body relative to the driveshaft is now also possible.

The effect of the eccentric drive journal on the guide body is thus used fundamentally to move the guide body with the orbital path balancing mass such that the orbital path balancing mass follows the orbital path of the drive member and produces the necessary mass balancing.

In particular, it is favorable here if the orbital path balancing mass is guided by the guide body engaging with the driveshaft on a path which runs in a path plane which runs parallel to an alignment plane running perpendicularly to the central axis of the driveshaft.

As a result of the interaction between the guide body and the driveshaft, it is thus achieved that any tilting moments possibly still occurring are transmitted from the orbital path balancing mass by means of the guide body to the driveshaft and therefore generate substantially no tilting moments acting on the eccentric driveshaft.

The guidance of the guide body on the driveshaft can be implemented in a wide range of ways.

A favorable solution provides that the guide body is guided by means of a guide face at an alignment face of the driveshaft.

With regard to the alignment face provided on the driveshaft, it would be conceivable for example to arrange the alignment face on a collar of the driveshaft.

A particularly simple solution, which is also stable in respect of the guidance of the guide body, provides that the alignment face provided on the driveshaft is an end face of the driveshaft.

The guide body can also be supported optimally on the alignment face if the guide body is arranged in a manner extending beyond the alignment face.

With regard to the arrangement of the guide body, it is also favorable for space-related reasons if the guide body is arranged between the alignment face of the driveshaft and the drive member.

In this case, there is the possibility to configure the eccentric drive such that it takes up a small amount of space, in spite of the provision of the guide body.

It is particularly favorable if the guide body is formed in a plate-shaped manner, that is to say has a minimal extent in the direction of the central axes compared to its extent transverse to the central axis.

In order to safeguard the guidance of the guide body by the driveshaft and in particular to ensure same where possible in all operating states, it is preferably provided that the guide body is guided relative to the driveshaft by an axial guide.

In particular, the axial guide is formed here such that it holds the guide face of the guide body in abutment against the alignment face of the driveshaft, so as to ensure a sufficiently precise guidance of the guide body and therefore of the orbital path balancing mass relative to the driveshaft.

The axial guide can be formed here in a wide range of different ways.

The axial guide is preferably formed such that it comprises an element acting on the guide body on a side opposite the guide face.

An element of this kind can be formed in a wide range of ways.

In particular, it is provided that the element is a screw head of a screw engaging in the driveshaft.

Another solution provides that the element is a retaining ring fixed relative to the driveshaft.

A further advantageous solution provides that the element is a projection arranged on the eccentric drive journal.

For example, the axial guide can be implemented by means of a screw engaging with the driveshaft and/or a collar on the eccentric drive journal and/or a journal which is molded on the driveshaft and has a retaining ring.

In order to also provide the guide body and the orbital path balancing mass with the possibility of being able to be aligned relative to the eccentric drive journal in accordance with the particular unbalance, it is preferably provided that the guide body is rotatable relative to the eccentric drive journal to a limited extent.

By means of a limited rotatability of this kind, it is ensured on the one hand that the alignment of the guide body and therefore of the orbital path balancing mass relative to the eccentric drive journal remains within the scope of a permissible rotation, for example when the compressor is stopped, but on the other hand the guide body with the orbital path balancing mass thus has the possibility to align itself in accordance with the unbalance generated by the movement of the drive member on the orbital path so as to counteract said unbalance to the best possible extent.

To this end, a first movement limiting unit is preferably effective between the driveshaft and the guide body and allows a limited free rotatability of the guide body about the eccentric journal axis.

Here, the limited free rotatability lies in the range of from 0.5° (angle degrees) to 5°, preferably in the range of from 1° to 3°.

The movement limiting unit can be provided here by independent elements.

A particularly favorable embodiment of the movement limiting unit provides that the first movement limiting unit is formed by a stop body held on the guide body or the driveshaft and a recess receiving the stop body and arranged on the driveshaft or the guide body.

A particularly advantageous solution, however, provides that the movement limiting unit is provided by the elements of the axial guide such that the axial guide on the one hand brings about the movement of the guide body in the axial direction, that is to say in the direction of the central axes either of the driveshaft or of the second movable compressor body, and on the other hand is used simultaneously as a movement limiting unit.

It is also favorable if the orbital path balancing mass is arranged on a side, opposite the eccentric drive journal, of a geometric transverse plane running perpendicularly to the mass balancing plane and through the central axis of the driveshaft.

Alternatively or additionally to the above-described features of a solution according to the invention, a further solution of the object stated at the outset provides that the eccentric drive journal is arranged in a fixed manner in the driveshaft and engages in a drive journal receptacle in the drive member, such that the drive member is driven within the drive journal receptacle by the effect of the eccentric drive journal on the drive member.

In this case it is particularly favorable if the eccentric drive journal and the drive journal receptacle cooperate in a contact region through which a central plane passes, which central plane runs in the direction of the central axis centrally of a rotary bearing for the drive member acting between the second compressor body and the drive member, and if a gap between the eccentric drive journal and drive journal receptacle is present on either side of the contact region.

Alternatively, the position of the central plane can also be defined in that it runs centrally through the rotary bearing for the drive member, perpendicularly to the eccentric journal axis and in the direction of the eccentric journal axis.

This solution has the great advantage that the eccentric drive journal acts with its force moving the drive member on the orbital path as close as possible to this central plane of the rotary bearing and thus prevents the force effect of the eccentric drive journal from leading to tilting moments acting on the drive member, which in turn would result in a reduction of the stability of the rotary bearing for the drive.

It is particularly favorable here if the eccentric drive journal and the drive journal receptacle cooperate in a central portion of the drive journal receptacle, wherein in particular the central portion is defined in that the central plane passes through it.

In particular, it is provided here that the drive journal receptacle in the central portion has a smaller diameter than end portions of the drive journal receptacle arranged on either side of the central portion and each forming a gap.

It is preferably provided here that the central portion of the drive journal receptacle extends at most over half, and even better at most over a third of the extent of the drive journal receptacle in the direction of the eccentric journal axis.

It is also preferably provided that the end portions arranged on either side of the central portion differ at most by a factor of 2 in respect of their extent in the direction of the eccentric journal axis.

It is hereby ensured that the contact region in which the eccentric drive journal acts on the drive journal receptacle is located as close as possible to the central plane.

Alternatively or additionally to the above-describe solutions, a particularly favorable solution provides that the orbital path balancing mass is coupled by means of a coupling body to the drive member so as to also be rotated by the drive member in the event of rotation of the drive member about the eccentric drive journal.

The advantage of this solution can therefore be considered that the orbital path balancing mass is thus always disposed such that it compensates the eccentric movement, caused by the arrangement and disposition of the drive member, of the movable compressor body together with the drive member and the drive member receptacle.

This can be particularly easily implemented in that the coupling body is effective between the guide body and the drive member.

Here, the coupling body is preferably arranged fixedly on either of the guide body or drive member and engages in a recess in the other of the guide body or drive member.

It is preferably provided here that the coupling body is arranged in the recess with play.

A play of this kind is advantageously provided if both the guide body with the orbital path balancing mass and the drive member are in each case arranged rotatably relative to the eccentric drive journal and therefore the coupling body is to be arranged at a spacing from the eccentric drive journal such that an absence of play between the coupling body and the recess would thus result in an over-determination of the connection between the position of the coupling body and the recess relative to the eccentric drive journal.

The provided play thus avoids the over-determination and is also used in addition to facilitate the lubrication.

Here, in particular the coupling body and the recess are arranged such that the coupling body in normal operation of the compressor abuts against a portion of a wall face of the recess and consequently a defined alignment of the orbital path mass relative to the drive member is still provided even without an over-determined positioning of the coupling body and recess.

A particularly advantageous solution provides that the coupling body is formed as a coupling journal, with which the connection for co-rotation between the orbital path balancing mass and the drive member can be provided in a simple way.

An advantageous development of the solution according to the invention also provides that the coupling journal is arranged fixedly on the guide body and engages in the recess in the drive member.

In order to prevent tilting moments from acting on the drive member via the coupling journal, it is preferably provided that the coupling journal and the recess cooperate in a contact region through which a central plane passes, which central plane runs perpendicularly to the journal axis of the coupling journal and runs in the direction of the coupling journal centrally of a rotary bearing for the drive member effective between the second compressor body and the drive member, and that a gap between the coupling journal and the recess is provided on either side of the contact region.

A transmission of tilting moments can thus largely be avoided in the same way as with the drive of the drive member by the eccentric drive journal.

In particular, it is preferably provided here that the coupling journal and the recess cooperate in a central section of the recess.

This can be implemented easily for example in that the recess in the central portion has a smaller diameter than in the end portions of the recess arranged on either side of the central portion and each forming a gap.

With regard to the extent of the central portion, likewise no further details have been provided in conjunction with the above descriptions.

It is preferably provided that the central portion of the recess extends at most over half of the extent of the recess in the direction of the journal axis.

It is also preferably provided that the end portions arranged on either side of the central portion differ at most by a factor of 2 in respect of their extent in the direction of the journal axis.

The object stated at the outset is also achieved alternatively or additionally to the previously described solutions in that the eccentric drive comprises the eccentric drive journal driving the drive member and comprises a coupling body coupling the orbital path balancing mass to the drive member.

It is particularly advantageous in this context if the coupling body also constitutes a mass balancing body. With this solution it is possible in a simple way to compensate in particular the unbalance of the eccentric drive journal, which is caused by the eccentric drive journal and is asymmetrical with respect to the mass balancing plane, and therefore to improve the smooth running of the compressor.

An advantageous solution thus provides that the eccentric drive journal and the coupling body are arranged on mutually opposed sides of a mass balancing plane such that, besides the coupling of the orbital path balancing mass to the drive member, the unbalance caused by the eccentric drive journal is also compensated in a simple way and the smooth running is improved.

With regard to the course of the mass balancing plane, likewise no further details have as yet been provided.

An advantageous solution thus provides that the mass balancing plane runs through the central axis of the driveshaft and the central axis of the compressor body movable in an orbiting manner and is defined in an exact manner by these two central axes in respect of its position and orientation.

In order to achieve maximal smooth running, it is preferably provided that the coupling body has a mass which deviates at most by 20%, even better at most by 10%, from the mass of the eccentric drive journal so as to achieve the greatest possible compensation of the unbalance caused by the eccentric drive journal.

It is also preferably provided that the coupling body has substantially the same mass, in particular the same mass, as the eccentric drive journal.

So as to also create identical conditions as in the eccentric drive journal to the greatest possible extent in respect of the mass distribution, it is preferably provided that the coupling body is configured as a mass balancing journal.

With regard to the arrangement of the axes of the mass balancing journal and of the eccentric drive journal, it is preferably provided that a journal axis of the mass balancing journal is arranged at the same spacing from the mass balancing plane as an eccentric journal axis of the eccentric drive journal.

Likewise, no further details have as yet been provided in respect of the orientation of the axes.

It is particularly favorable if the journal axis of the mass balancing journal runs substantially parallel, preferably parallel, to the eccentric drive axis of the eccentric journal.

It is also particularly favorable if the journal axis of the mass balancing journal and the eccentric journal axis of the eccentric journal run parallel to the mass balancing plane.

With regard to the arrangement of the mass balancing journal, no further details have as yet been provided.

For example, it would be conceivable to arrange the mass balancing journal on the driveshaft or on the drive member.

A particularly favorable solution provides that the mass balancing journal is held on the guide body of the orbital path balancing mass and therefore moves together therewith and is aligned relative to the eccentric drive journal.

In the case in which the mass balancing body is configured as a mass balancing journal it is also preferably provided that the mass balancing journal engages in the recess provided in the drive member.

Within the scope of the solution according to the invention, no further details regarding the overall performed unbalance compensation have been described.

In particular, it is provided here that the above-described orbital path balancing mass is arranged symmetrically to the mass balancing plane and therefore does not bring about any asymmetrical unbalance relative to the mass balancing plane.

A particularly favorable solution also provides that the orbital path balancing mass is arranged on a side, opposite the eccentric drive journal and the mass balancing body, of a geometric transverse plane running perpendicularly to the mass balancing plane and through the central axis of the driveshaft.

With regard to a further unbalance compensation, in particular of the driveshaft, likewise no further details have as yet been provided in conjunction with the solutions described hitherto.

An advantageous solution thus provides that the driveshaft has a portion facing the compressor, which portion carries an unbalance compensation mass facing the compressor and carries the eccentric drive journal and in particular guides the mass balancing body and the orbital path balancing mass.

The unbalance compensation mass is preferably arranged on the driveshaft between a rotor of the drive motor and a front bearing unit.

A favorable solution also provides that the driveshaft has a portion facing away from the compressor, which portion carries an unbalance compensation mass facing away from the compressor.

It is preferably provided in the case of this unbalance compensation mass as well that said mass is arranged between the rotor of the drive motor and a rear bearing unit of the driveshaft.

Likewise in the case of these unbalance compensation masses, which are arranged on the driveshaft, it is preferably provided that they are likewise formed and arranged symmetrically with respect to the mass balancing plane.

Further features and advantages of the invention are the subject of the following description and illustration in the drawings of a number of exemplary embodiments.

DETAILED DESCRIPTION OF THE INVENTION

Figure 1:
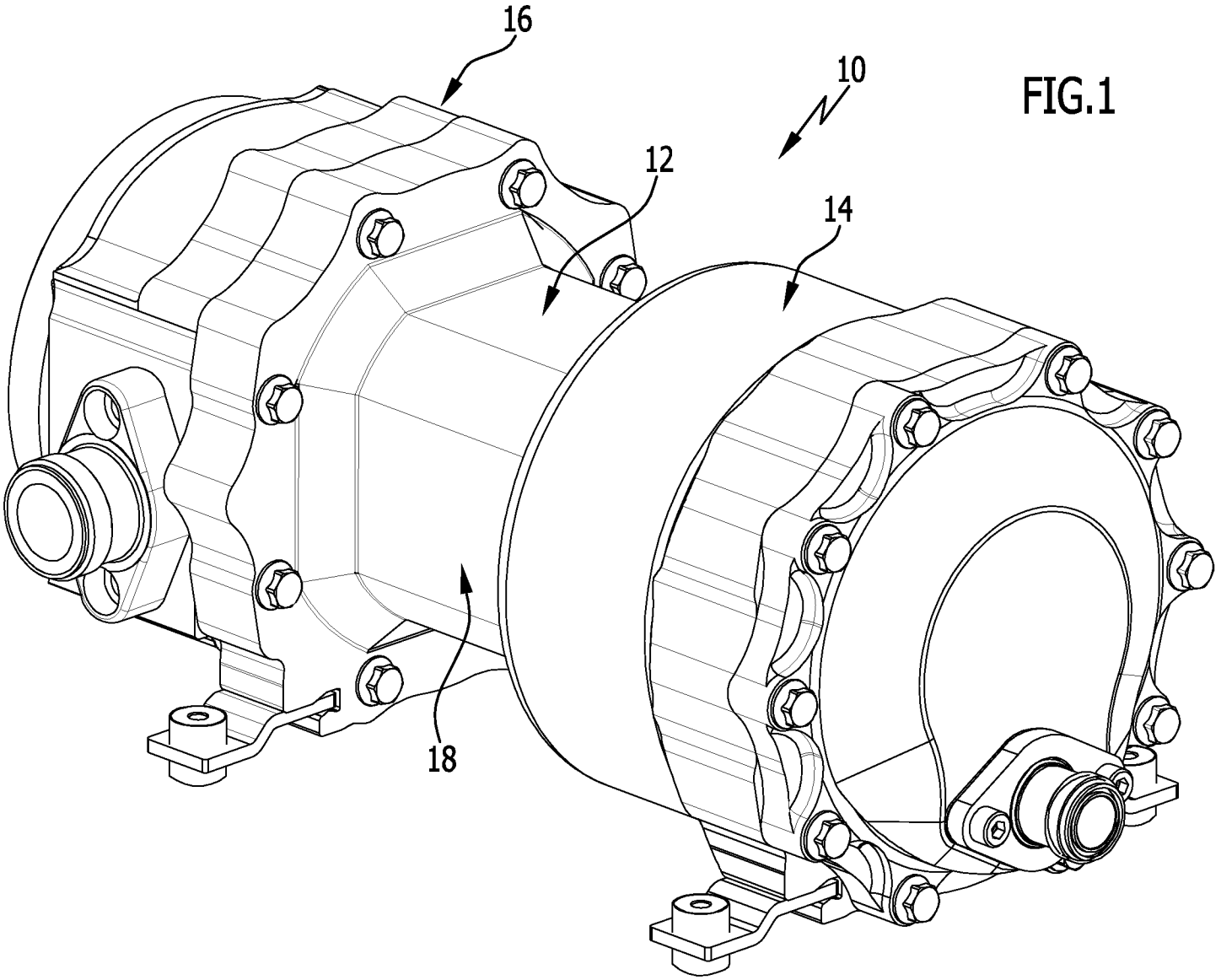
FIG. 1 a perspective illustration of a first exemplary embodiment of a compressor according to the invention.

A first exemplary embodiment, shown in FIG. 1, of a compressor according to the invention denoted as a whole by 10, said compressor being intended for a gaseous medium, in particular a refrigerant, comprises a compressor housing denoted as a whole by 12, which compressor housing has a first end-side housing portion 14, a second end-side housing portion 16, and an intermediate portion 18 arranged between the end-side housing portions 14 and 16.

As shown in FIG. 2 to FIG. 7, a scroll compressor unit denoted as a whole by 22 is provided in the first housing portion 14 and has a first stationary compressor body 24 in the compressor housing 12, in particular in the first housing portion 14, and has a second compressor body 26, which is movable relative to the stationary compressor body 24.

The first compressor body 24 comprises a compressor body base 32, from which a first scroll rib 34 is raised, and the second compressor body 26 likewise comprises a compressor body base 36, from which a second scroll rib 38 is raised.

Figure 2:
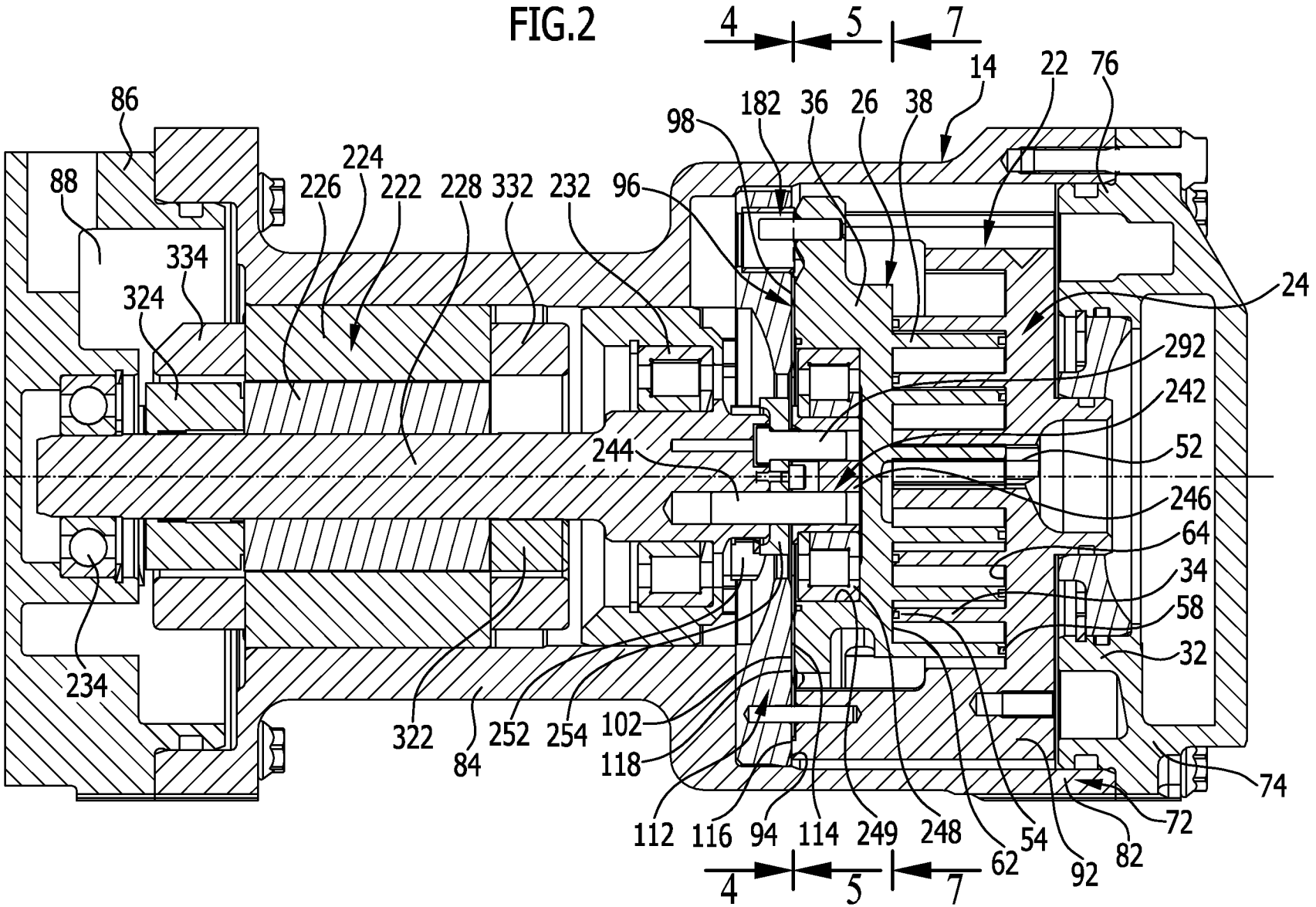
FIG. 2 a longitudinal section along line 2-2 in FIG. 4.
Figure 3:
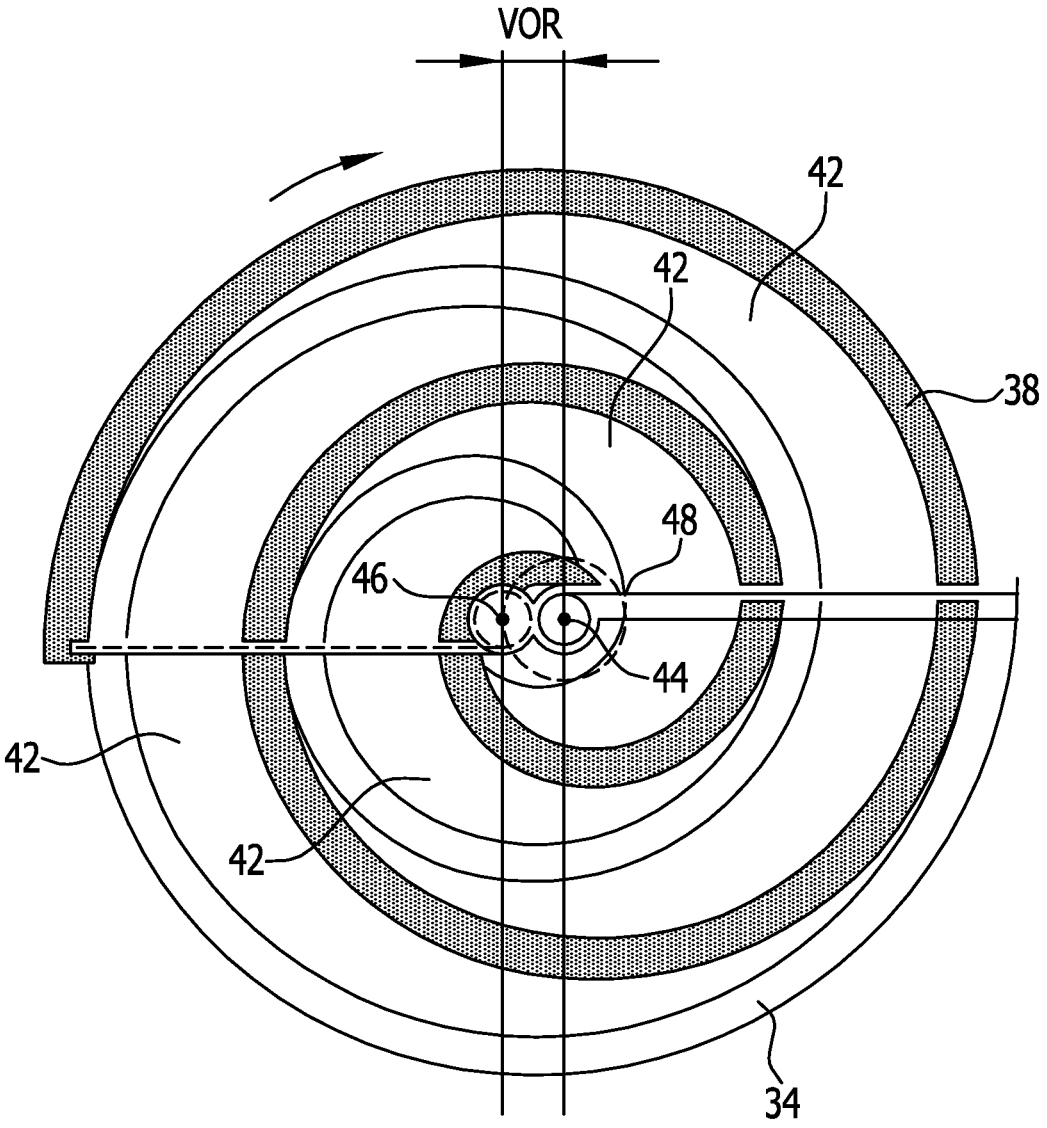
FIG. 3 a schematic illustration of scroll ribs engaging in one another and of the orbiting movement of one of the scroll ribs and an illustration of the orbital path of the movable scroll rib relative to the stationary scroll rib.

The compressor bodies 24 and 26 are arranged relative to one another such that the scroll ribs 34, 38, as shown in FIG. 3, engage in one another so as to form therebetween at least one compressor chamber, preferably a plurality of compressor chambers 42, in which the gaseous medium, for example refrigerant, is compressed in that the second compressor body 26 moves with its central axis 46 about a central axis 44 of the first compressor body 24 on an orbital path 48 with a compressor orbital path radius VOR, wherein the volume of the compressor chambers 42 is reduced and finally compressed gaseous medium exits through a central outlet 52 (FIG. 2), whereas gaseous medium to be drawn in is drawn in radially outwardly in relation to the central axis 44 through compressor chambers 42 that are open on the peripheral side.

The compressor chambers 42 are sealed relative to one another in particular also in that the scroll ribs 34, 38 are provided on the end face with axial sealing elements 54 and 58, which abut tightly against the corresponding base face 62, 64 of the other compressor body 26, 24 respectively, wherein the base faces 62, 64 are formed by the respective compressor body bases 36 and 32 and in each case lie in a plane running perpendicularly to the central axis 44.

The scroll compressor unit 22 is received as a whole in a first housing body 72 of the compressor housing 12, which comprises an end-face cover portion 74 and a cylindrical ring portion 76, which is molded integrally on the end-face cover portion 74 and which for its part engages by means of an annular projection in a sleeve body 82 of the housing body 72, which is molded on a central housing body 84 forming the intermediate portion 18, wherein the central housing body 84 is closed on a side opposite the first housing body 72 by a second housing body 86, which forms an inlet chamber 88 for the gaseous medium.

The sleeve body 82 here surrounds the scroll compressor unit 22, the first compressor body 24 of which is supported by means of support fingers 92, molded on the compressor body base 32, on a bearing face 94 in the housing body 72.

In particular the first compressor body 24 is fixed immovably in the housing body 72 with respect to all movements parallel to the contact face 94.

The first compressor body 24 is thus fixed in a stationary manner in an exactly defined position within the first housing body 72 and thus also within the compressor housing 12.

Figure 4:
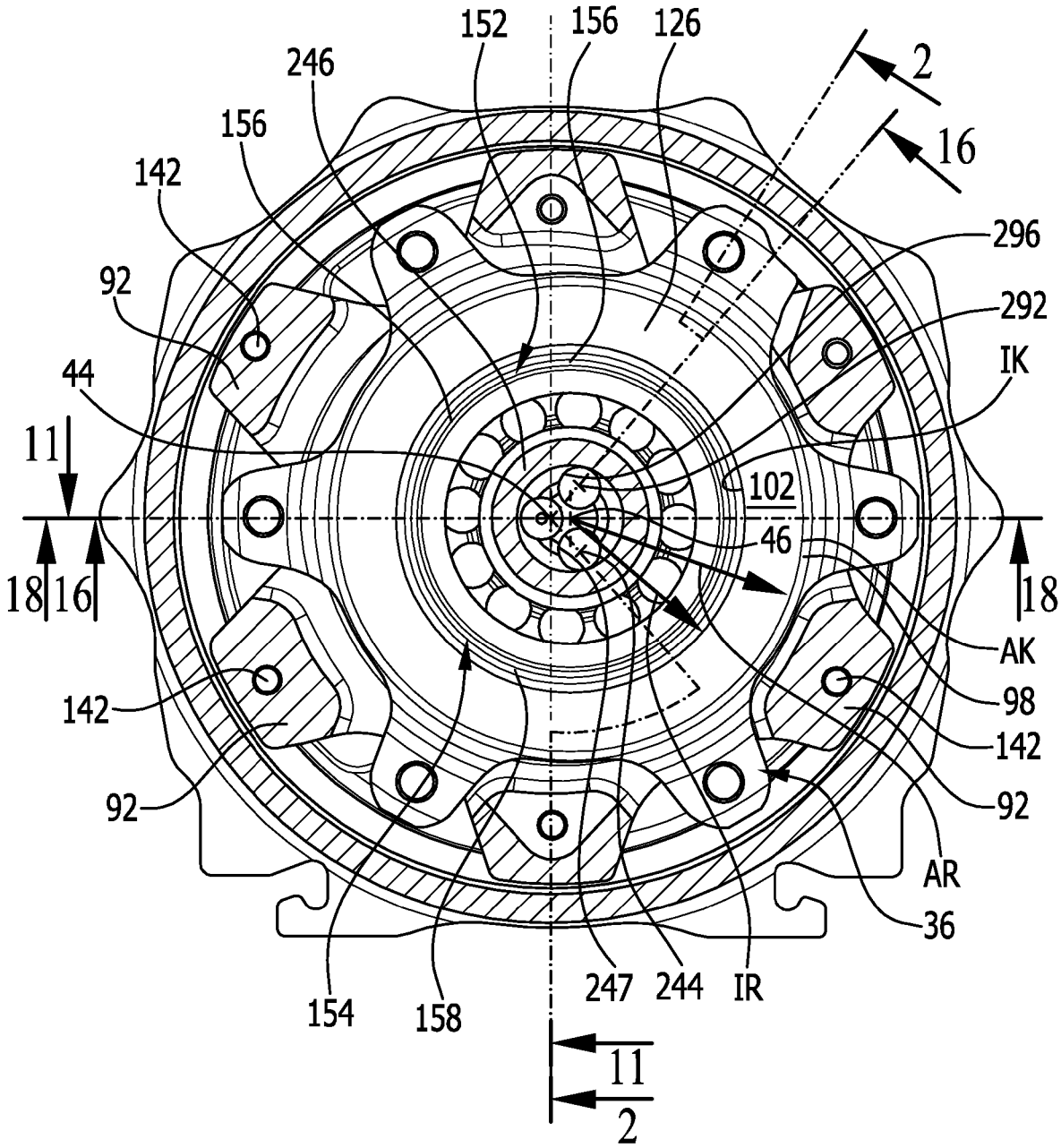
FIG. 4 a section along line 4-4 in FIG. 2.

The second movable compressor body 26, which must move on the orbital path 48 about the central axis 44 relative to the first compressor body 24, is guided, based on the central axis 44, in the axial direction by an axial guide denoted as a whole by 96, which axial guide supports and guides the compressor body base 36 on an underside 98 facing away from the scroll rib 38, more specifically in the region of an axial support face 102, such that the compressor body base 36 of the second compressor body 26 is supported relative to the first compressor body 24, which is positioned in a stationary manner in the compressor housing 12, and in a direction parallel to the central axis 44, in such a way that the axial sealing elements 58 remain on the base face 64 and do not lift therefrom, wherein at the same time the compressor body base 36 with the axial support face 102 can move in a sliding manner transversely to the central axis 44 relative to the axial guide 96 (FIGS. 2 and 4).

To this end, as shown in FIG. 2, the axial guide 96 is formed by a carrier element 112 which has a carrier face 114 facing the axial support face 102 (FIGS. 2 and 5), wherein, however, the compressor body base 36 does not abut on said carrier face by means of the axial support face 102, and instead a sliding body 116 denoted as a whole by 116 and formed in particular in a plate-shaped manner abuts on said carrier face by means of a sliding contact face 118, wherein the sliding body 116 with a sliding support face 122 opposite the sliding contact face 118 (FIGS. 2 and 5) supports the axial support face 102 (FIGS. 2 and 4) with respect to movements parallel to the central axis 44, but guides it in a supported manner slidingly in respect of movements transverse to the central axis 44.

So that an axial movement of the second compressor body 26 in the direction of the central axis 44 is prevented however, a movement in a plane transverse to, in particular perpendicular to the central axis 44 is made possible.

The axial guide 96 according to the present invention provides that, in the event of a movement of the second compressor body 26 on the orbital path 48 about the central axis 44 of the first compressor body 24, on the one hand the second compressor body 26 moves with the compressor body base 36 and the axial support face 102 thereof relative to the sliding body 116, wherein on the other hand the sliding body 116 for its part moves in turn relative to the carrier element 118.

There is thus a sliding between the compressor body base 36 and the sliding body 116 by a movement of the axial support face 102 relative to the sliding support face 122 of the sliding body 116, and in addition there is a sliding of the sliding contact face 118 of the sliding body 116 relative to the carrier face 114 of the carrier element 112.

Figure 5:
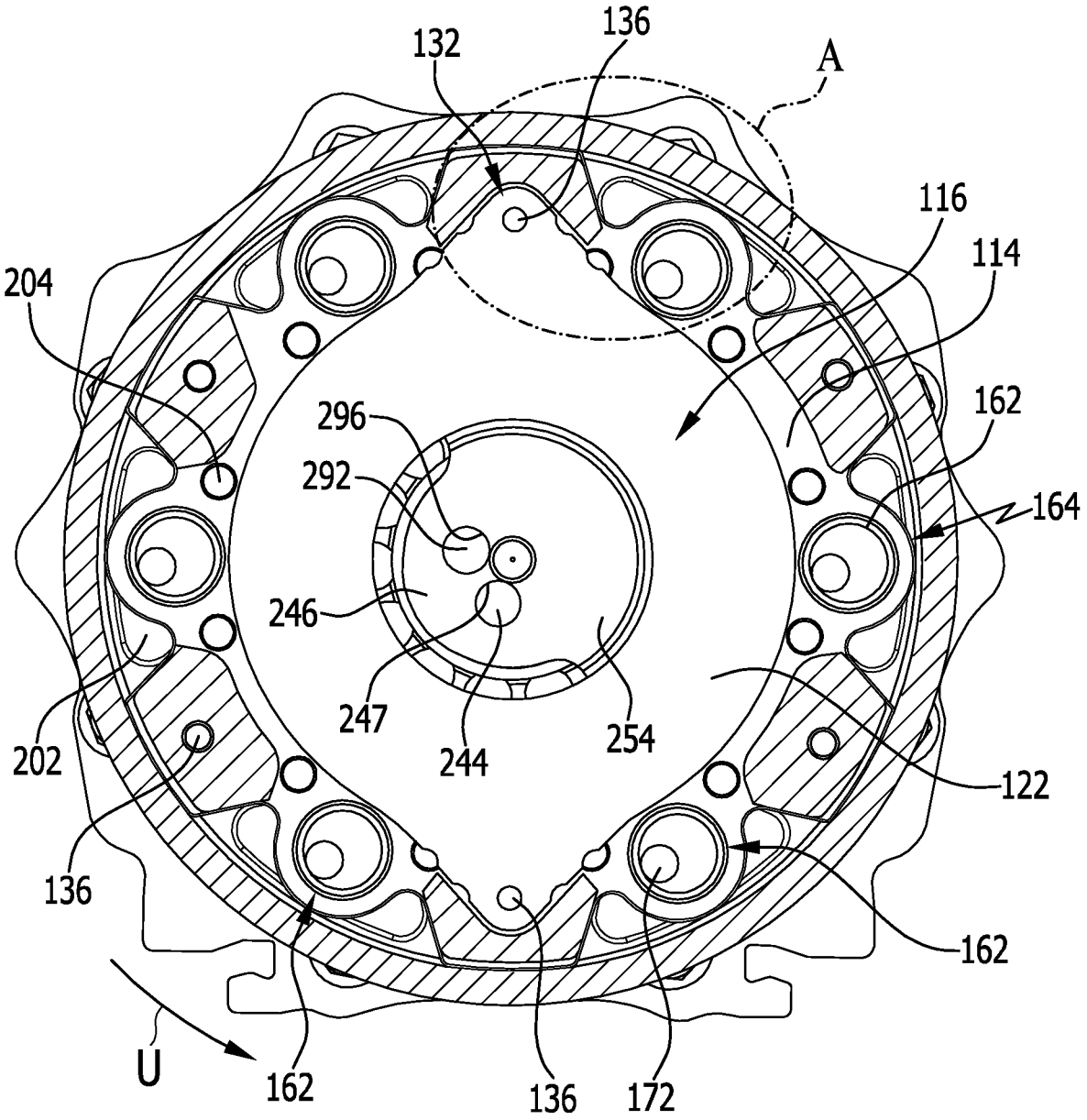
FIG. 5 a section along line 5-5 in FIG. 2.
Figure 6:
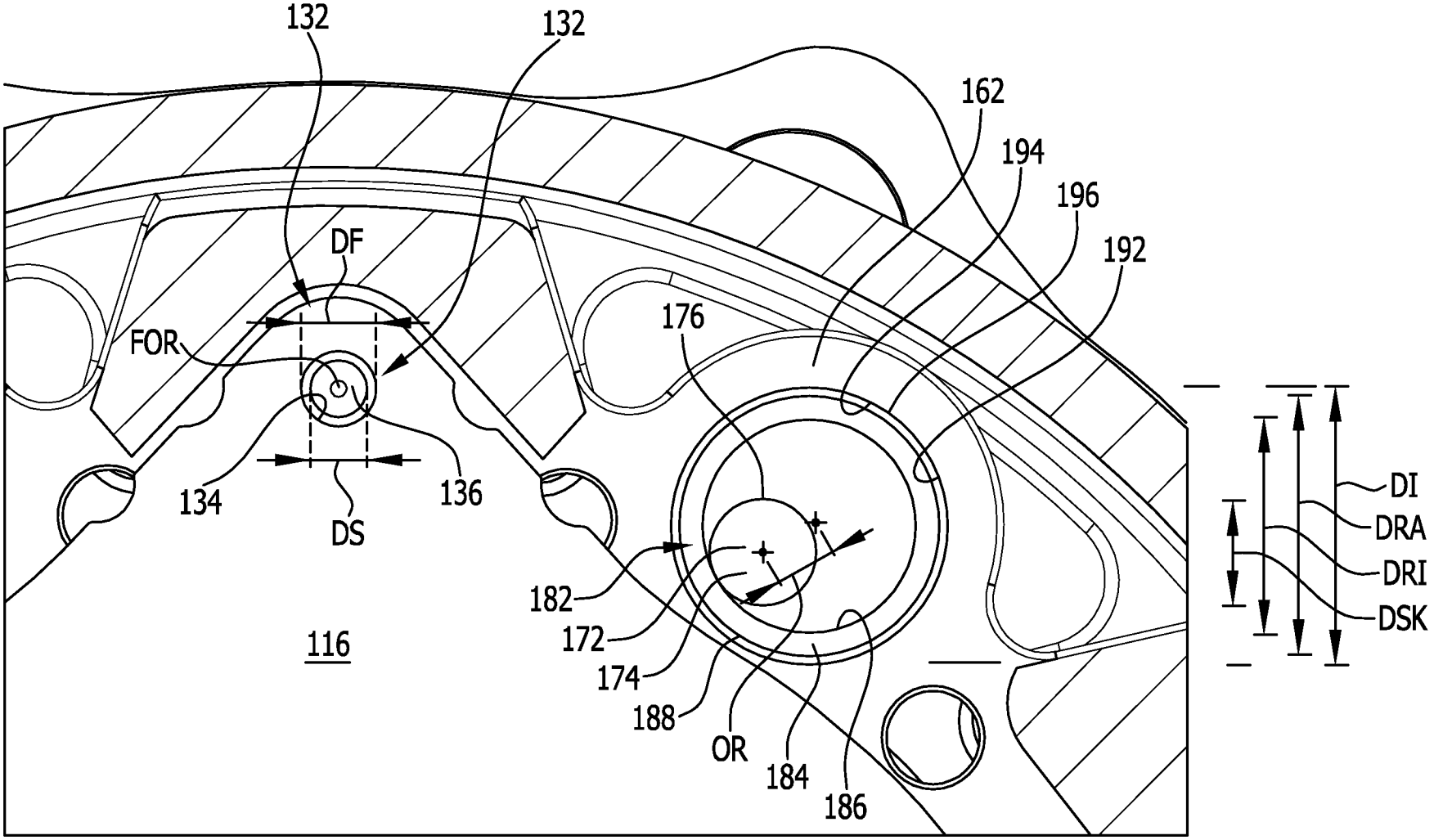
FIG. 6 an enlarged illustration of a region A in FIG. 5.

In order to predefine the limited two-dimensional movability of the sliding body 116 parallel to a plane perpendicular to the central axis 44 relative to the carrier element 112, the sliding body 116 is guided relative to the carrier element 112 with play by a guide shown in FIGS. 5 and 6 and denoted as a whole by 132, wherein the guidance with play 132 comprises a guide recess 134 provided in the sliding body 116, which recess has a diameter DF, and comprises a guide pin 136 anchored in the carrier element 112, the diameter DS of said guide pin being smaller than the diameter DF, such that half of the difference DF-DS defines a guide orbital radius with which the sliding body 116 can perform an orbiting movement relative to the carrier element 112.

As a result of the movements of the sliding body 116, a sufficient lubricating film builds up between the axial support face 102 of the compressor body base 36 and the sliding support face 122 of the sliding body 116, and between the carrier face 114 and the sliding contact face 118.

For a stable lubricating film it is sufficient if the guide orbital radius FOR is 0.01 times the compressor orbital radius or more, in particular 0.05 times the compressor orbital radius or more.

For example, on account of the fact that the carrier element 112 is produced from an aluminum alloy at least in the region of the carrier face 114, an improved lubrication is also additionally ensured in that lubricant infiltrates the pores of the carrier element 112 and is thus available for the build-up of the lubricating film in the gap via the surface structures of the carrier element 112 for example provided in the region of the carrier face 114.

Since the sliding body 116 itself is formed as a plate-shaped, annular part made of spring steel and therefore the sliding contact face 118 facing the carrier face 114 is a smooth spring steel surface, the formation of the lubricating film is additionally promoted.

Furthermore, the material pairing of the aluminum alloy, which in the region of the carrier face 114 is softer than spring steel, and of the spring steel in the region of the sliding contact face 118 has advantageous properties for smooth running on account of the resistance to wear.

In the solution according to the invention the carrier element 112 is not only provided with the carrier face 114, on which the sliding body 116 abuts, but also with the contact faces 94 on which the support fingers 92 of the first compressor body 24 are supported.

It is thus possible to fix the position of the first compressor body 24 and the position of the second compressor body 26 in the direction of the central axis 44 relative to one another by suitable construction of the carrier element 112, wherein this is achieved in particular by a single face of the carrier element 112, which comprises both the carrier face 114 and the contact faces 94.

Furthermore (as shown in FIGS. 2 and 4 to 6), the non-rotatable fixing of the support fingers 92 relative to the carrier element 112 is achieved both by the carrier element 112 and also the positioning pins 142 passing through the support fingers 92.

The carrier element 112 is also arranged in the housing body 72 in a manner fixed both axially in the direction of the central axis 44 and in respect of rotary movements about the central axis 44.

So as to also ensure the build-up of a lubricating film formed of lubricant between the sliding support face 122 and the axial support face 102, the compressor body base 36 is provided in a radially inner edge region 152 and in a radially outer edge region 154 with edge faces 156 and 158 running at an incline relative to the axial support face 102 and set back in relation to the axial support face 102, which edge faces together with the sliding contact face 122 each lead to a gap opening radially outwardly or inwardly, respectively, in a wedge-shaped manner, said gaps facilitating the entry of lubricant.

The build-up of the lubricating film between the sliding support face 122 and the axial support face 102 is also promoted in that the sliding support face 122 and the axial support face 102, in the overlap region in which they cooperate, are formed as continuous ring faces 124 and 126, i.e. as ring faces not interrupted in the circumferential direction U about the central axis or over their entire radial extent, wherein in particular the ring face 126 of the axial support face 102 extends starting from an inner contour IK with a radius IR to an outer contour AK, wherein the radius IR is less than two thirds of an outer radius AR.

The ring face 124 of the sliding support face 122 is also dimensioned such that the ring face 126 of the axial support face 102 always abuts on it over the entire surface in the event of all movements relative to the sliding support face 122.

As is shown in FIGS. 2 to 6, the axial support face 102 and the sliding support face 122 cooperating therewith and also the carrier face 114 and the sliding contact face 118 cooperating therewith all lie radially within a coupling 164 comprising a plurality of coupling element sets 162, which are arranged at equal radial spacings from the central axis 44 and at equal angular spacings in the circumferential direction U about the central axis 44 and together form a coupling 164 which prevents the second movable compressor body 26 from rotating by itself.

Figure 7:
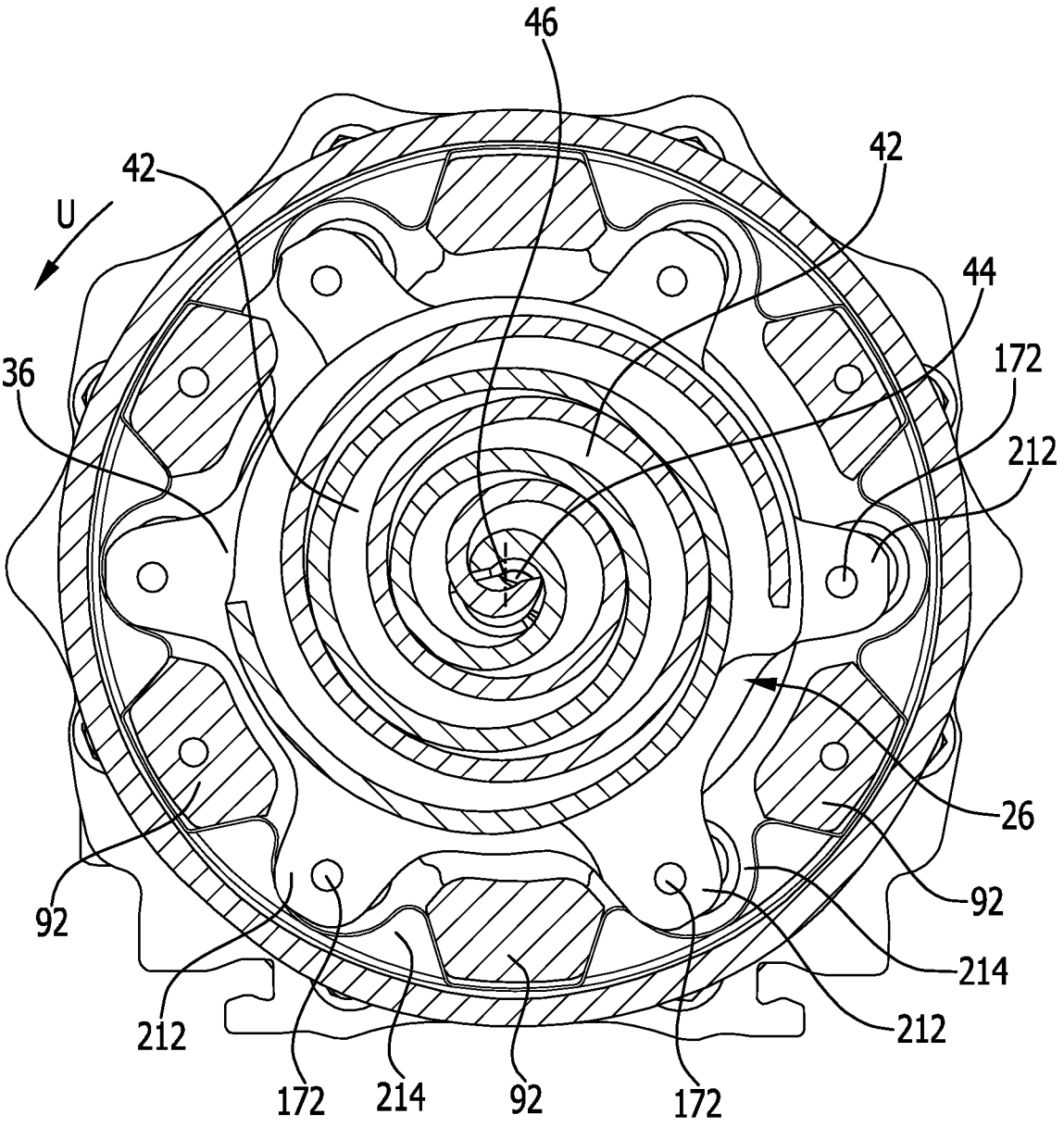
FIG. 7 a section along line 7-7 in FIG. 2.

Each of these coupling element sets 162, as shown in FIGS. 2, 6 and 7, comprises a pin body 174 as first coupling element 172, which pin body has a cylindrical lateral surface 176 and by means of this cylindrical lateral surface 176 engages in a second coupling element 182.

The second coupling element 182 is formed by an annular body 184 which has a cylindrical inner face 186 and a cylindrical outer face 188 which are arranged coaxially with one another.

This second coupling element 182 is guided in a third coupling element 192 which is formed as a receptacle 194 for the annular body 184, is provided in the carrier element 112 and has a cylindrical inner wall face 196.

Here, the diameter DI of the inner wall face 196 is in particular greater than the diameter DRA of the cylindrical outer face 188 of the annular body 184, and the diameter DRI of the cylindrical inner face 186 is necessarily smaller than the diameter DRA of the cylindrical outer faces 188 of the annular body 184, wherein in addition the diameter DRI of the cylindrical inner face 186 is greater than a diameter DSK of the cylindrical lateral surface 176 of the pin body 174.

Each coupling element set 162 thus for its part forms an orbital guide, the maximum orbital radius OR of which for the orbiting movement corresponds to DI/2−(DRA−DRI)/2−DSK/2.

As a result of the dimensioning of the orbital radius OR of the coupling element sets 162 in such a way that said radius is slightly greater than the compressor orbital path radius VOR, defined by the compressor bodies 24 and 26 of the scroll compressor unit 22, the movable compressor body 26 is guided relative to the stationary compressor body 24 by the coupling 164 in such a way that in each case one of the coupling element sets 162 is effective in order to prevent the second movable compressor body 26 from rotating by itself, wherein, for example with six coupling element sets 162, when an angular range of 60° has been passed through, the efficiency of each coupling element set 162 changes from one coupling element set 162 to the coupling element set 162 following next in the direction of rotation.

On account of the fact that each coupling element set 162 comprises three coupling elements 172, 182 and 192 and in particular an annular body 184 between the particular pin body 174 and the particular receptacle 194, on the one hand the wear resistance of the coupling element sets 162 is improved, on the other hand the lubrication in the region thereof is improved, and in addition the production of noise by the coupling element sets 162 created by the change of efficiency from one coupling element set 172 to the other coupling element set 162 is also reduced.

Here, it is in particular essential that the coupling element sets 162 experience a sufficient lubrication, in particular a lubrication between the cylindrical lateral surface 176 of the pin body 174 and the cylindrical inner face 186 of the annular body 184 as well as a lubrication between the cylindrical outer face 188 of the annular body 184 and the cylindrical inner wall face 196 of the receptacle 194.

For optimal lubrication of the coupling element sets 162, the receptacles 194 in the carrier element 112 are open on both sides in the axial direction, wherein the annular bodies 184 are held on their sides facing away from the second compressor body 26 by a radially inwardly protruding stop element 198.

In addition, further through-openings 202, 204 are also provided in the carrier element 112 and allow a passage of lubricant and drawn-in refrigerant.

In order to receive the coupling elements 172 formed as pin bodies 174, the compressor body base 36 is provided with star-shaped extensions 212 extending radially outwardly, which extensions engage in gaps 214 between support fingers 92 arranged in succession in a circumferential direction U about the central axis 44, such that the coupling elements 172 likewise lie in these gaps 214 and thus are arranged within the housing body 72 at the greatest possible radial spacing from the central axis 44 (FIG. 7).

This positioning of the coupling element sets 162, predefined by the greatest possible radial spacing of the coupling elements 172, likewise at the greatest possible radial spacing from the central axis 44 has the advantage that, on account of the large lever arm, the forces acting on the coupling element sets 162 can thus be kept as small as possible, which has an advantageous effect on the component dimensioning.

The concept according to the invention of lubricating the axial guide 96 and the coupling element sets 162 is in particular advantageous if the central axes 44 and 46 of the compressor bodies 24 and 26 run horizontally in the normal case, that is to say at most with an angle of 30° to the horizontal, wherein a lubricant bath 210 forms in the compressor housing 12, in particular in the region of the first housing body 72 at the deepest point in the direction of the force of gravity, from which bath lubricant is swirled up during operation and in so doing is collected and distributed in the described way.

The drive of the movable compressor body 24 is achieved (as shown in FIG. 2) by a drive motor denoted as a whole by 222, for example an electric motor, which in particular comprises a stator 224 held in the central housing body 84 and a rotor 226 arranged within the stator 224, which rotor is arranged on a driveshaft 228 which runs coaxially with the central axis 44 of the stationary compressor body 24.

The driveshaft 228 is on the one hand mounted in a bearing unit 232 facing the compressor and arranged between the drive motor 222 and the scroll compressor unit 22 and in the central housing body 84, and on the other hand in a bearing unit 234 facing away from the compressor and arranged on a side of the drive motor 222 opposite the bearing unit 232.

The bearing unit 234 facing away from the compressor is mounted here for example in the second housing body 86, which closes off the central housing body 84 on a side opposite the first housing body 72.

Drawn-in medium, in particular the refrigerant, flows here from the inlet chamber 88 formed by the second housing body 86, through the drive motor 222 in the direction of the bearing unit 232 facing the compressor, flows around said bearing unit, and then flows in the direction of the scroll compressor unit 22.

The driveshaft 228 drives the movable compressor body 26 via an eccentric drive denoted as a whole by 242, which compressor body moves in an orbiting manner about the central axis 44 of the stationary compressor body 24.

Figure 8:
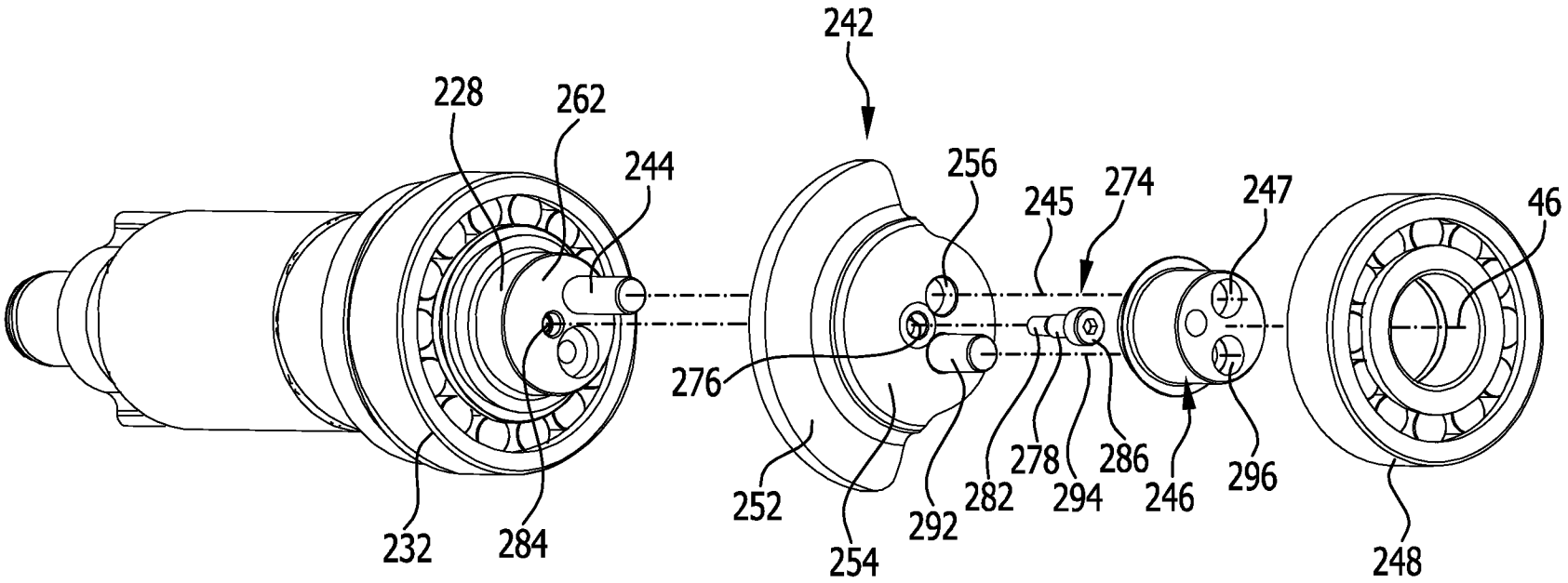
FIG. 8 an exploded illustration of the cooperation between an eccentric drive journal of an orbital path balancing mass and a drive member in the compressor according to the invention.

The eccentric drive 242 comprises in particular an eccentric drive journal 244, which is held in the driveshaft 228 and which moves a drive member 246 on the orbital path 48 about the central axis 44, which drive member for its part is mounted on the eccentric drive journal 244 so as to be rotatable about an eccentric journal axis 245 by a rotatable mounting of the eccentric drive journal 244 in a drive journal receptacle 247 in the drive member 246 and additionally is mounted in a rotary bearing 248, in particular a rolling element bearing formed as a fixed bearing, so as to be rotatable about the central axis 46 of the compressor body 26 movable in an orbiting manner, wherein the rotary bearing 248 allows a rotation of the drive member 246 about the central axis 46 relative to the compressor body 26 movable in an orbiting manner, as shown in FIGS. 7 and 8.

Figure 11:
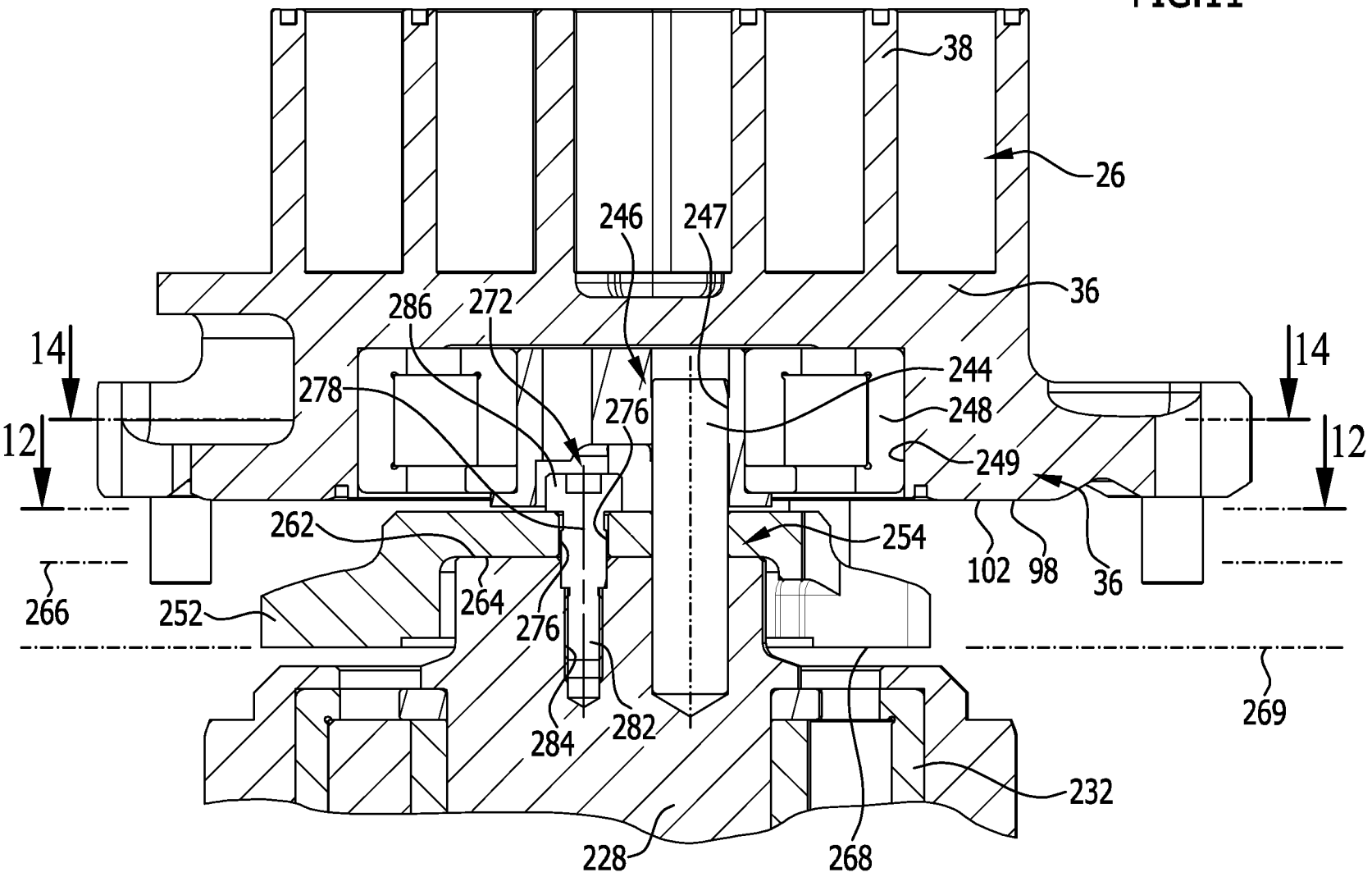
FIG. 11 an enlarged section along line 11-11 in FIG. 4.
Figure 14:
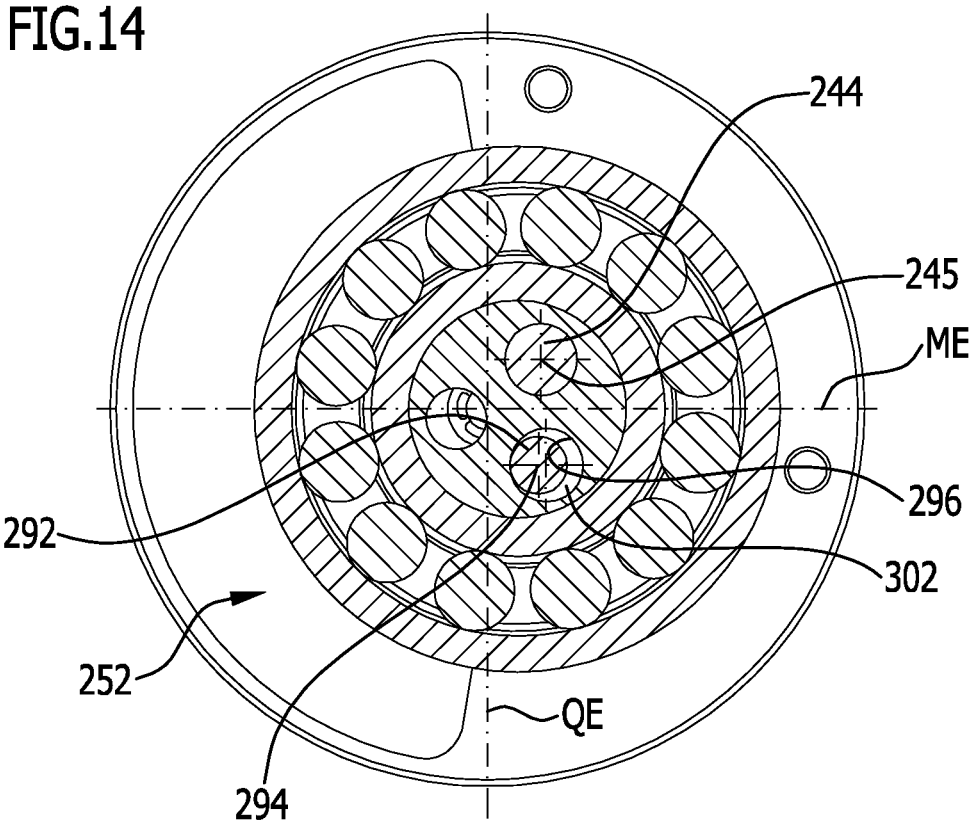
FIG. 14 a section along line 14-14 in the region of a drive member receptacle of the movable compressor body with a drive member in FIG. 11 in the position according to FIG. 12.
Figure 12:
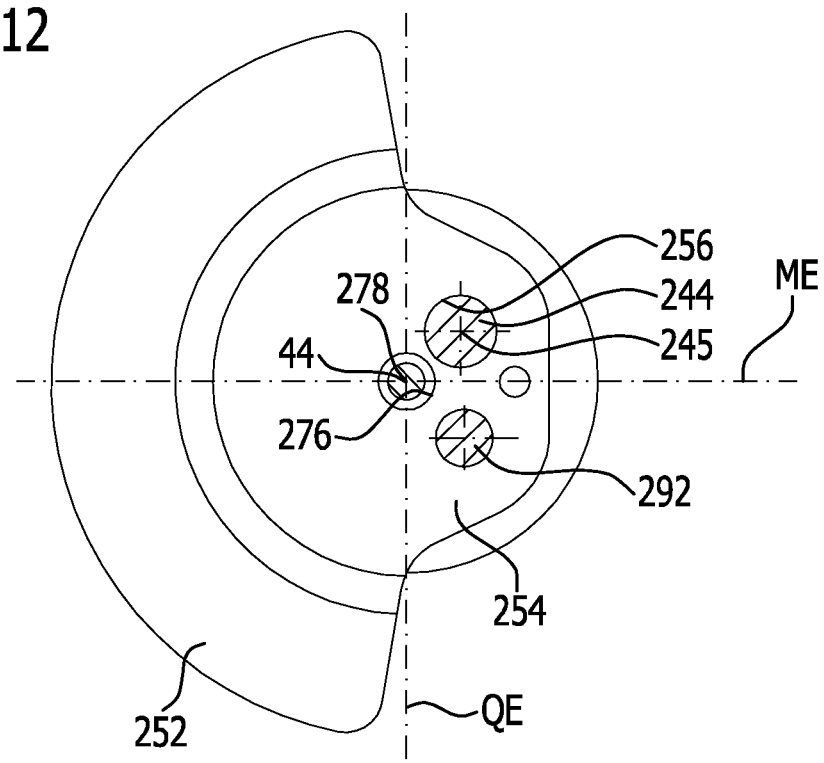
FIG. 12 a section along line 12-12 in FIG. 11, but only with illustration of the unbalance compensation mass and the guide body.
Figure 15:
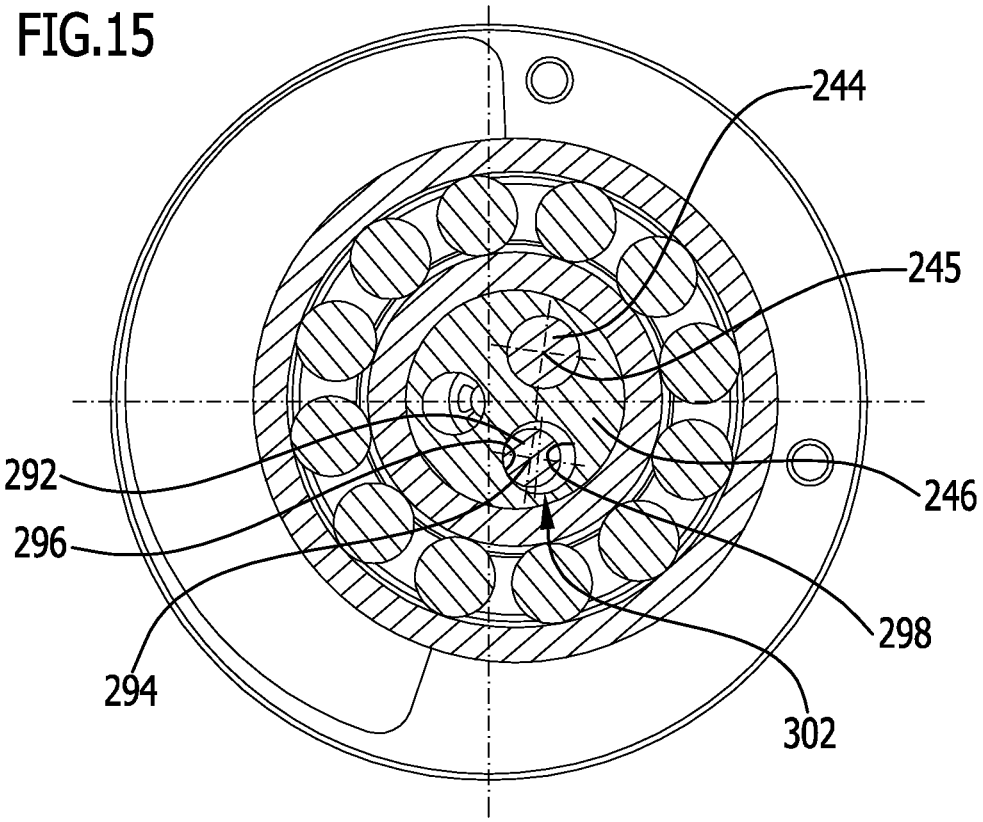
FIG. 15 a section similar to FIG. 14 in the position according to FIG. 13.

In order to receive the rotary bearing 248, the second compressor body 26 is provided with an integrated drive member receptacle 249, as shown in FIG. 11, which receives the rotary bearing 248.

The drive member receptacle 249 is set back here relative to the flat side 98 of the compressor body base 36 and is thus arranged in an integrated manner in the compressor body base 36, such that the drive forces acting on the movable compressor body 26 are effective on a side of the flat side 98 of the compressor body base 36 facing the scroll rib 38 and thus drive the movable compressor body 26 with a small tilting moment, which compressor body, by means of the axial guide 96 as considered in the direction of the central axis 44, is axially supported between the drive member receptacle 249 and the drive motor 222 and is guided movably transversely to the central axis 44.

In the solution according to the invention the drive member receptacle 249, as shown in FIGS. 2 and 11, is surrounded by the axial support face 102 arranged outwardly relative to the central axis 46 in the radial direction, and the axial support face 102 is for its part surrounded by the coupling element sets 162, arranged outwardly relative to the central axis 44 in the radial direction, of the coupling 164 preventing the second compressor body 26 from rotating by itself.

As a result of the rotatability of the drive member 246 about the eccentric journal axis 245 and about the central axis 46, the compressor orbital radius VOR in particular, defined by the spacing of the central axis 46 of the movable compressor body 24 from the central axis 44 of the stationary compressor body 24 and the driveshaft 228, is variably adjustable, such that the movable compressor body 26 and therefore also the central axis 46 can each be moved radially outwardly away from the central axis 44 to such an extent that the scroll ribs 34, 38 bear against one another and close off the compressor chambers 42 tightly.

Figure 9:
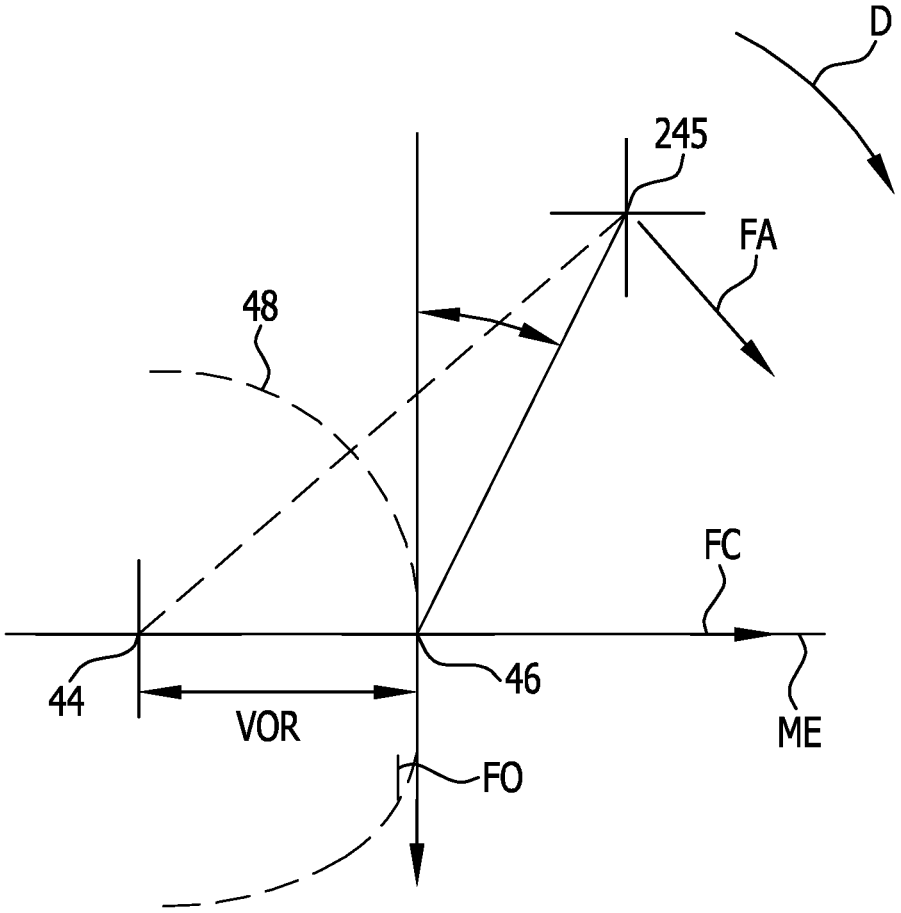
FIG. 9 a schematic geometric illustration of the relative position of the central axes of the compressor bodies and of an eccentric journal axis.

To this end, in particular the spacing of the eccentric journal axis 245 from the central axis 44 of the stationary compressor body 24 is selected to be greater than the provided compressor orbital radius VOR, that is to say the spacing of the central axes 44 and 46 from one another, and so great that the eccentric journal axis 245 is arranged at a spacing from the driveshaft 228 outside a central axis plane ME running through the two central axes 44 and 46 and counter to a rotational direction D of the driveshaft (FIG. 9).

On account of this arrangement of the central axes 44 and 46 and of the eccentric journal axis 245, the resultant eccentric effect of the eccentric drive journal 244 on the drive member 246 brings about a force FA, which, based on the central axis 46 of the drive member 246, leads to a force FC acting on the central axis 46 and moving the drive member 246 together with the movable compressor body 26 radially outwardly relative to the central axis 44, which force FC acts in the central axis plane ME running through the central axis 44 and the central axis 46 and is the result of a force FO acting tangentially relative to the orbital path 48 and moving the drive member 246 together with the movable compressor body 26 on the orbital path 48 about the central axis 44 (FIG. 9).

The central axis plane ME defined by the central axes 44 and 46 constitutes a plane of symmetry with respect to a system formed from the mass of the driveshaft 228 and the mass of the movable compressor body 26 together with the mass of the drive member 246 and is also referred to as the mass balancing plane ME.

Figure 10:
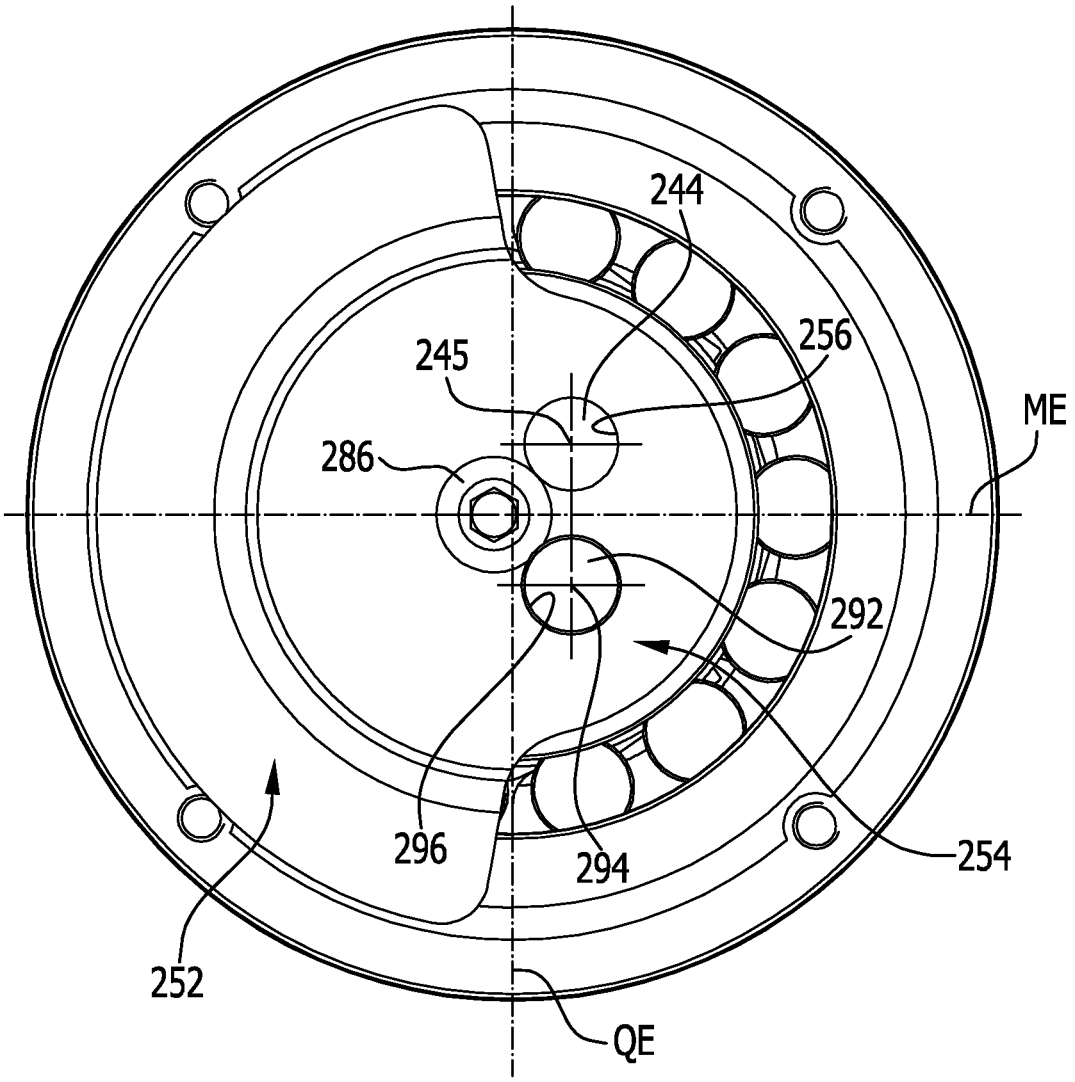
FIG. 10 a plan view of a guide body with the orbital path balancing mass in its position on the driveshaft with eccentric drive journal passing through the guide body.

An orbital path balancing mass 252 is additionally also provided for mass balancing and counteracts the unbalance by the compressor body 26 moving on the orbital path 48 and compensates this to the greatest possible extent, wherein the orbital path balancing mass 252 is also formed and arranged symmetrically with respect to the mass balancing plane ME, as shown in FIG. 10.

Here, the orbital path balancing mass 252 lies in particular on a side, facing away from the eccentric drive journal 244, of a transverse plane QE running perpendicularly to the mass balancing plane ME and through the central axis 44.

In contrast to solutions known from the prior art, the orbital path balancing mass 252 is not held on the drive member 246, but instead is mounted by means of a guide body 254 on the driveshaft 228, in particular on the eccentric drive journal 244.

To this end, the guide body 254 comprises journal receptacle 256, which passes through the eccentric drive journal 244, in order to receive the bearing body 245 rotatably about the eccentric journal axis 245.

Furthermore, at an alignment face 262 of the driveshaft 228 facing the guide body 254 and arranged for example on the end face of the driveshaft 228, said guide body is guided slidingly by means of a guide face 264 of the guide body 254 facing the alignment face 262, parallel to an alignment plane 266 running perpendicularly to the central axis 44 of the driveshaft 228, such that the parallel alignment of the guide body 245 relative to the alignment plane 266 is maintained in the event of all rotational movements about the eccentric journal axis 245, and therefore the orbital path balancing mass 252 moves on a path 268 about the driveshaft 228 which runs in a path plane 269 parallel to the alignment plane 266.

The advantage of this solution can be considered to be that the orbital path balancing mass 252 shall be fully uncoupled from the drive member 246 and therefore no longer able to transmit tilting moments with respect to the central axes 44, 46 to the drive member 246.

Rather, the transmission of tilting moments from the guide body 254 to the eccentric drive journal 244 is also already largely avoided by the guidance of the guide body 254 relative to the driveshaft 228.

In order to hold the guide face 264 in abutment against the end face 262, an axial guide 272 for the guide body 254 relative to the driveshaft 228 is provided, which, in a first exemplary embodiment, is formed as a screw 274 which penetrates a recess or an aperture 276 in the guide body 254 by means of a shaft portion 278, engages by means of a thread portion 282 in a threaded bore 284 in the driveshaft 228 coaxial with the central axis 44, and by means of a screw head 286 extends beyond the aperture 276 on a side 287 of the guide body 254 facing the drive member 246, so as to hold the guide body 254 by means of the guide face 264 in abutment against the alignment face 262.

Figure 13:
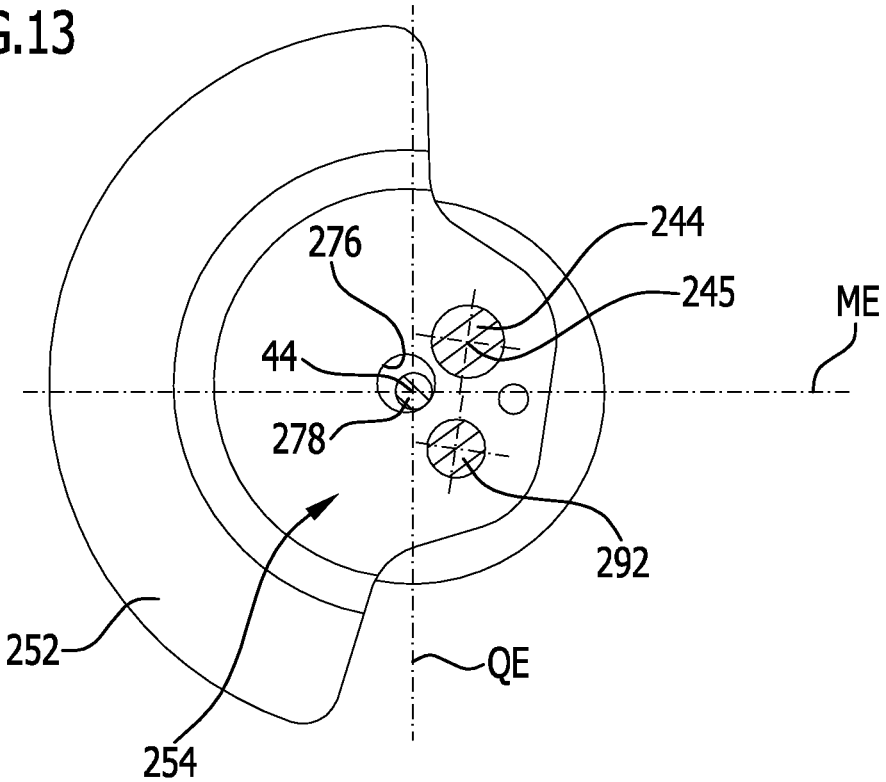
FIG. 13 a section similar to FIG. 12 with active first movement limiting unit.

Here, however, the aperture 276 is dimensioned such that a limited movement of the guide body 254 relative to the screw 274 and thus also a limited relative rotation of the unit formed of the orbital path balancing mass 252 and guide body 254 about the eccentric journal axis 244 is possible, as shown in FIG. 13.

The recess or the aperture 276 and the shaft portion 278 of the screw 274 thus form a first movement limiting unit 288 for the movement of the guide body 254 relative to the driveshaft 228.

The movement limiting unit 288 preferably allows a rotation of the guide body 254 relative to the eccentric drive journal axis 245 which lies in the range of at least ±1° (angle degrees) to at most ±3° (angle degrees), or even better at most ±2° (angle degrees) in order to enable a tolerance compensation, if the orbital path balancing mass 252 tends to adjust itself such that the most optimal orbital mass balancing possible occurs.

In order to ensure a co-rotation between the orbital path balancing mass 252 and the drive member 246 rotatable relative to the eccentric drive journal 244, a coupling journal 292 is provided as coupling body and is arranged fixedly on the guide body 254.

In order to provide the connection of the coupling journal 292 to the drive member 246, the drive member 246 is provided with a recess 296 which receives the coupling journal 292 with play, such that a rotary movement of the drive member 246 about the eccentric journal axis 245 in order to avoid a tolerance-sensitive and optionally also redundant connection of the drive member 246 can be achieved rotatably by the precise mounting of the drive member 246 relative to the eccentric drive journal 244 and by the additional connection of the drive member 246 to the coupling journal 292, which for its part is likewise mounted rotatably about the eccentric drive journal 244.

The coupling journal 292 and the recess 296 are preferably arranged such that the coupling journal 292 in normal operation abuts against a portion of an inner wall face 298 of the recess 296, said portion being arranged at the front in the direction of rotation.

The mass not taken into consideration in the above-described mass balancing is the mass of the eccentric drive journal 244, which is arranged asymmetrically with respect to the mass balancing plane ME and causes the driveshaft 228 to vibrate, in particular at high rotational speeds.

For this reason, in addition to the eccentric drive journal 244 engaging in the driveshaft 228, the coupling journal 292 arranged fixedly on the guide body 254 is also arranged as a mass balancing body (FIG. 8), which is arranged on the guide body 254 on a side of the mass balancing plane ME opposite the eccentric drive journal 244 (FIG. 10) and therefore together with the eccentric drive journal 244 leads in turn to an at least approximately symmetrical mass distribution with respect to the mass balancing plane ME.

A journal axis 294 of the coupling journal 292 and the eccentric journal axis 245 are preferably arranged mirror-symmetrically with respect to the mass balancing plane ME, and in addition the eccentric drive journal 244 and the coupling journal 292 preferably have approximately the same mass (FIG. 10).

The coupling journal 292 is fixed to the guide body 254 for example in that the coupling journal 292 passes through a receiving bore 312 in the guide body 254 and is fixed therein by a press fit.

Figure 16:
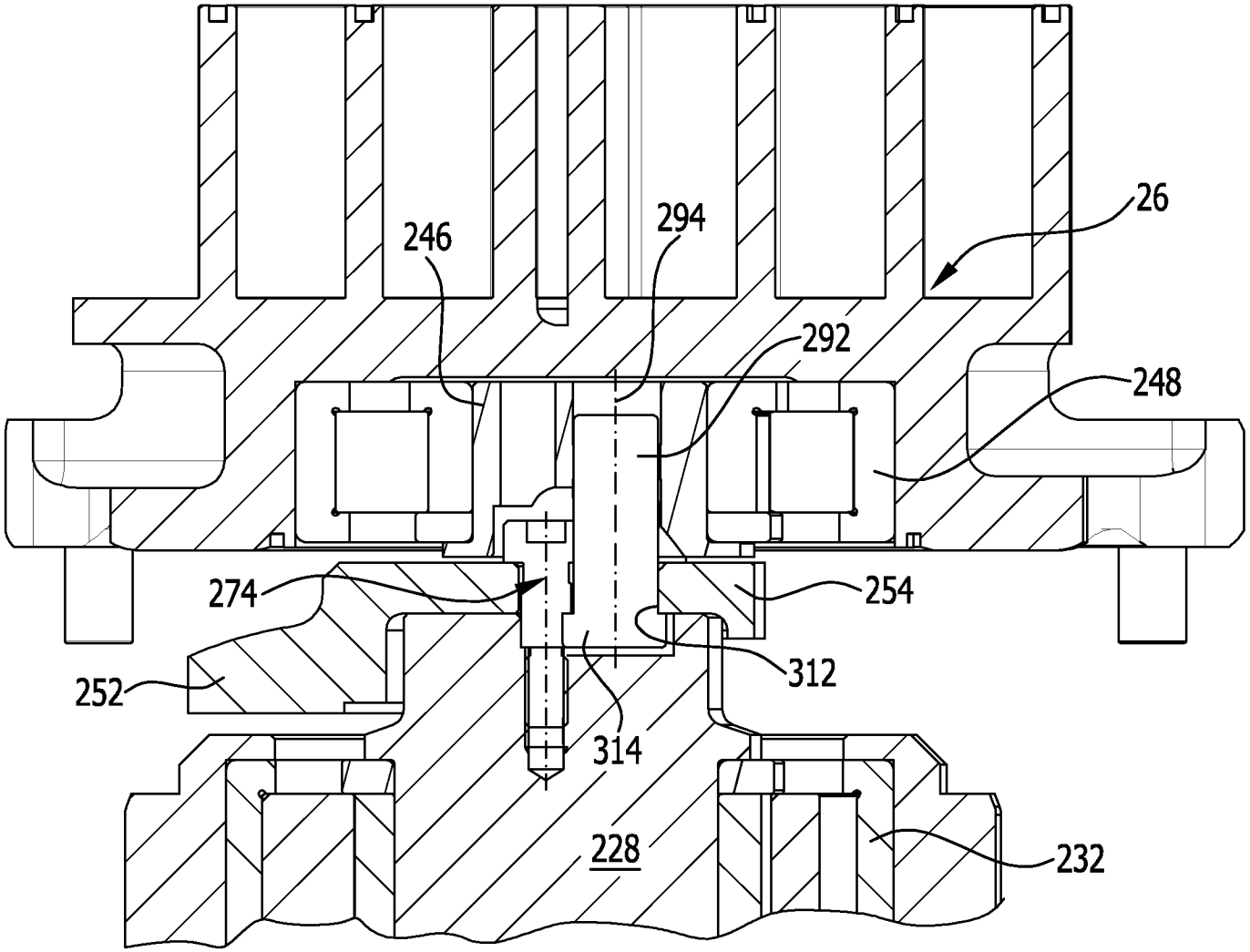
FIG. 16 an enlarged section along line 16-16 in FIG. 4 through a mass balancing journal.

To axially fix the position of the coupling journal 292 on the guide body 254, the coupling journal 292 is also provided with a head 314, which bears against a side of the guide body 254 facing away from the drive member 246 (FIG. 16).

Figure 17:
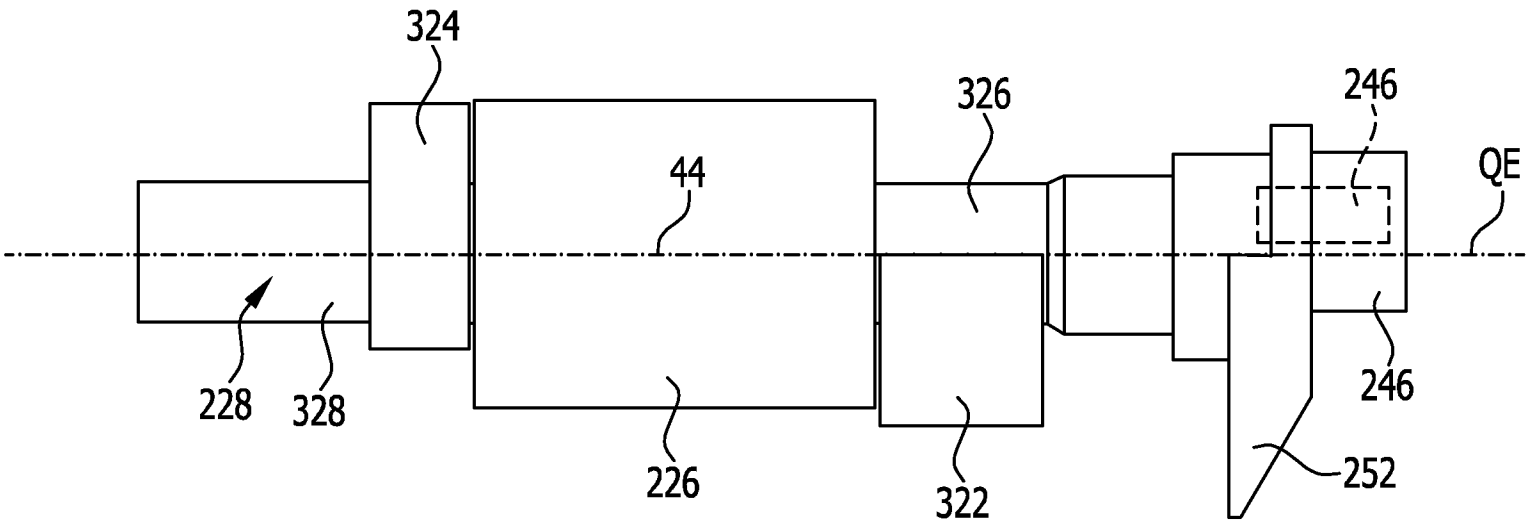
FIG. 17 a side view of a driveshaft with the drive member driven thereby.

For further mass balancing the driveshaft 228 is also provided with an unbalance compensation mass 322 facing the compressor and with an unbalance compensation mass 324 facing away from the compressor (FIGS. 2 and 17).

The unbalance compensation mass 322 facing the compressor is preferably arranged between the drive motor 222 and the bearing unit 232 facing the compressor on a portion 326 of the driveshaft 228 facing the compressor and radially within winding heads 332 of a stator winding, and this lies on the same side of the transverse plane QE as the orbital path balancing mass 252 and is arranged symmetrically with respect to the mass balancing plane ME.

The unbalance compensation mass 324 facing away from the compressor lies preferably on a portion 328 of the driveshaft 228 facing away from the compressor and between the drive motor 222 and the bearing unit 234 facing away from the compressor, and radially within winding heads 334 of the stator winding.

Figure 18:
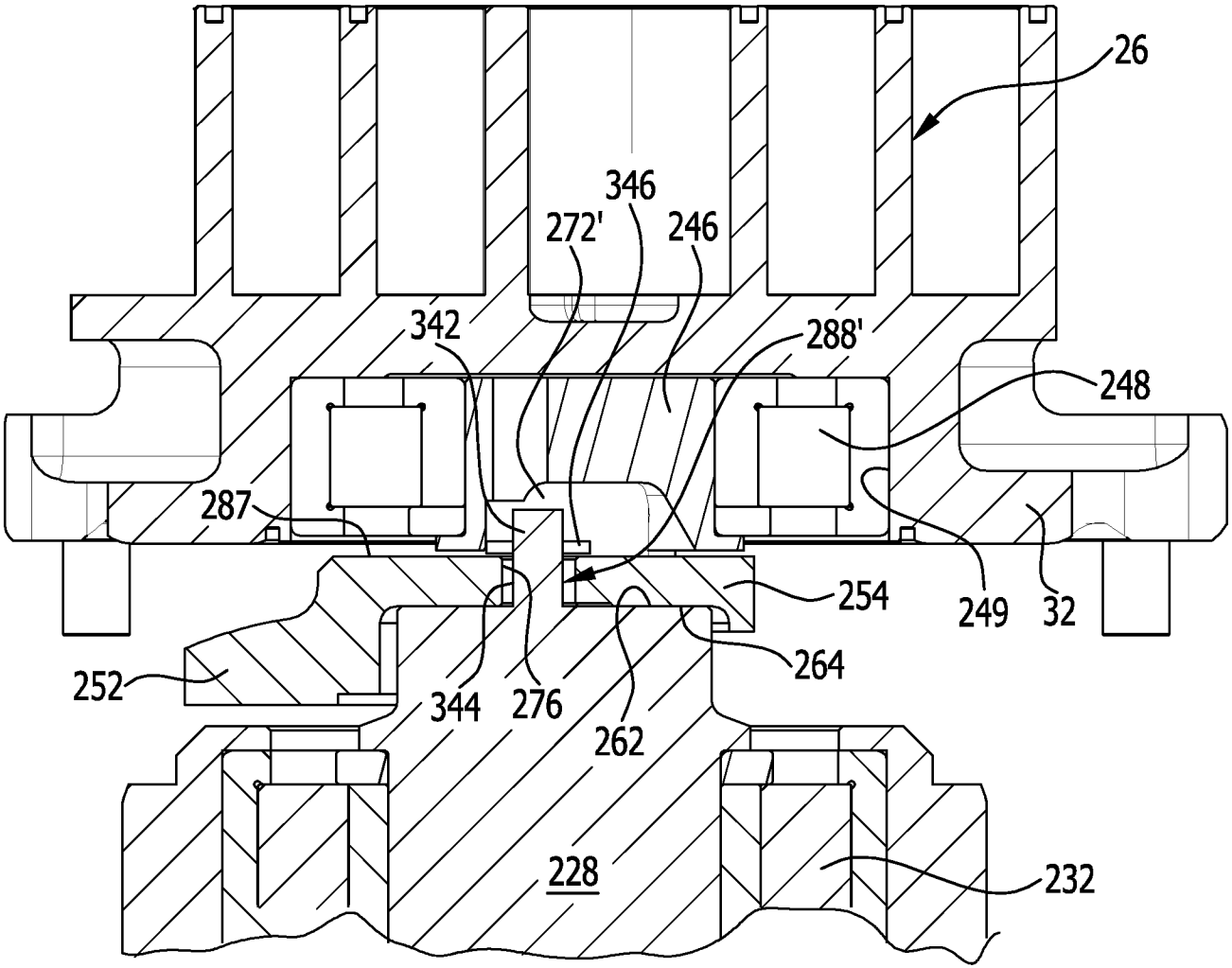
FIG. 18 an enlarged section along line 18-18 in FIG. 4 through a second exemplary embodiment of a compressor according to the invention.

In a second exemplary embodiment of the solution according to the invention, shown in FIG. 18, the axial guide 272' for the guide body 254 is formed by a journal 342 molded on the driveshaft 228, which journal passes through the aperture 276 in the guide body 254 by means of a shaft portion 344 and bears a retaining ring 346, which is arranged on the side 287 facing the drive member 246 in a manner extending beyond the aperture 276 radially and thus positions the guide body 254 in the same way as the screw head 286, such that the guide face 264 is held in abutment against the alignment face 262.

The shaft portion 344 thus also cooperates with the aperture 276 and forms the first movement limiting unit 288'.

All other features of the second exemplary embodiment are identical to those of the first exemplary embodiment, and therefore reference is made fully in this regard to the descriptions of the first exemplary embodiment.

Figure 19:
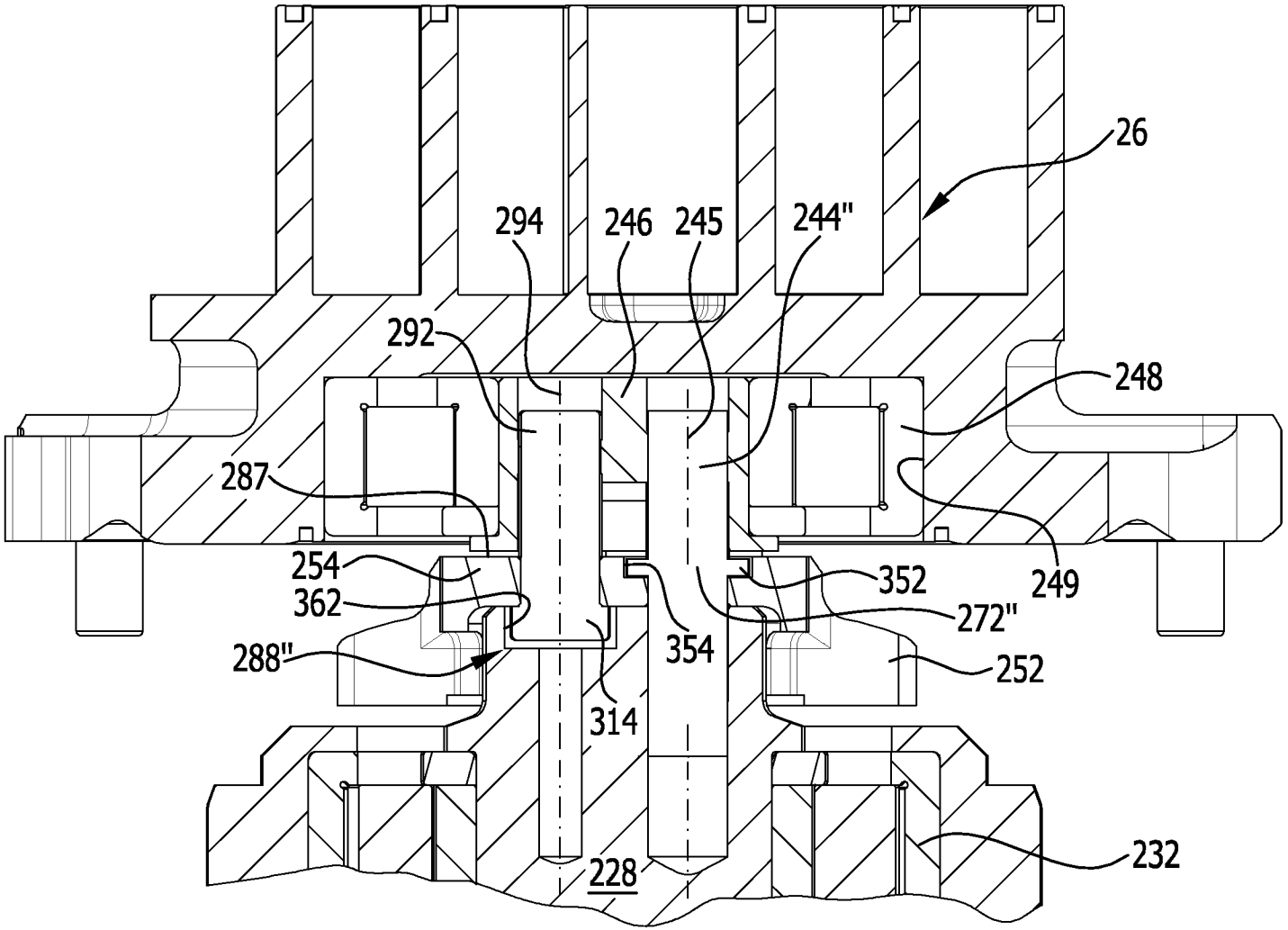
FIG. 19 a section similar to FIG. 11 through a third exemplary embodiment of a compressor according to the invention.

In a third exemplary embodiment of the solution according to the invention the axial guide 272" for the guide body 254 is formed by a projection 352, in particular a collar, which is molded on the eccentric drive journal 244" and, as shown in FIG. 19, secures the guide body 254 against a movement in the direction of the central axis 44 away from the alignment face 262 and to this end for example engages in an indentation 354, which extends from a side 287 facing the drive member 246 into the guide body 254 (FIG. 19).

In the second exemplary embodiment the first movement limiting unit 288" is also formed by the head 314 of the mass balancing journal 292, which engages with play in an end-face recess or indentation 362 in the driveshaft 228. The limited rotatability of the guide body 254 relative to the driveshaft 228 is thus defined by the relative dimensions of the head 314 and of the indentation 362.

For the rest, all other elements of the third exemplary embodiment are identical to those of the first exemplary embodiment, and therefore reference can be made fully in this regard to the descriptions of the first exemplary embodiment.

Figure 20:
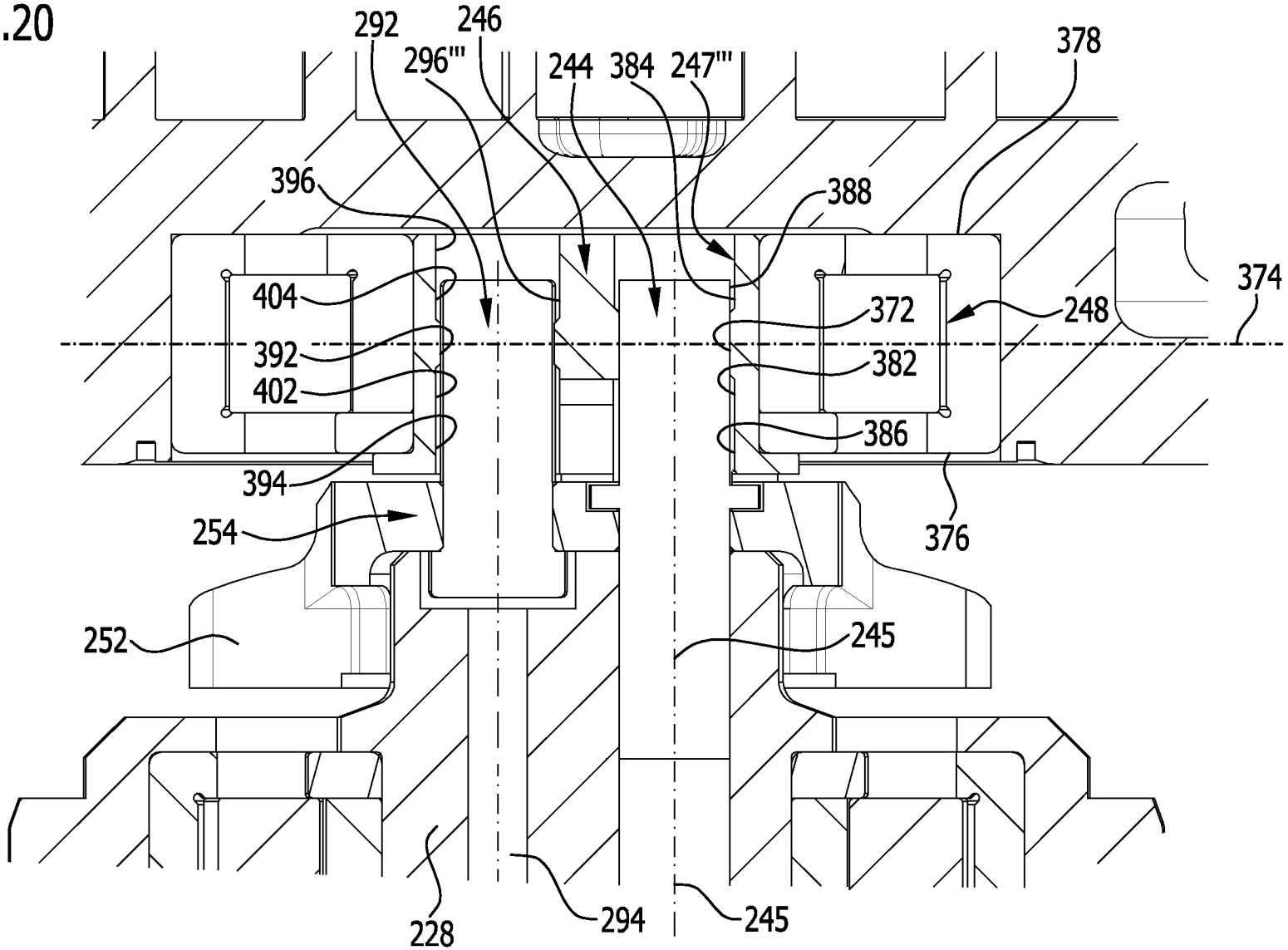
FIG. 20 a section similar to FIG. 11 through a fourth exemplary embodiment of a compressor according to the invention.

In a fourth exemplary embodiment of the solution according to the invention, shown in FIG. 20, the eccentric drive journal 244 cooperates with the drive journal receptacle 247'" merely in a central portion 372 thereof, which is arranged in the direction of the eccentric journal axis 245 in the drive journal receptacle 247'" such that it is intersected by a central plane 374 of the rotary bearing 248 running perpendicularly to a central axis 46 of the movable second compressor body 26 or perpendicularly to the eccentric journal axis 245 and lying centrally between the end faces 376 and 378 of said rotary bearing.

The central portion 372 here has an extent in the direction of the eccentric journal axis 245 which corresponds at most to half, even better at most a third of the extent of the drive journal receptacle in this direction.

End portions 382 and 384 of the drive journal receptacle 247'" are arranged on either side of the central portion 372, the diameter of said end portions being greater than that of the central portion 372 and said end portions extending in the direction of the eccentric journal axis 245 approximately with the same extent, which means that in particular the end portions 382, 384 differ in their extent by less than a factor of 2, such that in the region thereof a gap 386, 388 remains between each of the end portions 382 and 384 and the eccentric drive journal 244.

The eccentric drive journal 244 in this exemplary embodiment thus acts on the drive member 246 merely in the central portion 372 and thus merely in the region of the central plane 374, such that the rotary bearing 248, and also the drive member 246, does not experience any tilting moments as a result of the effect of the eccentric drive journal 244.

Similarly, the recess 296'" is also configured to receive the coupling journal 292 such that the coupling journal 292 acts on the recess 296'" in a central portion 392 of said recess, wherein the central portion 392 has an extent in the direction of the journal axis 294 similar or comparable to that of the central portion 372 of the drive journal receptacle 247".

End portions 394 and 396 of the recess 296'" are also likewise provided on either side of the central portion 392, the diameter of said end portions being greater than that of the central portion 392, such that likewise gaps 402 and 404 form between the end portions 394 and 396.

The end portions 394 and 396 extend in the direction of the journal axis 294 approximately with the same extent as the end portions 382 and 384, such that the same relationships relative to the central portion 392 are provided as between the central portion 372 and the end portions 382 and 384.

The coupling journal 292 in this exemplary embodiment thus acts on the drive member 246 likewise merely in the central portion 392 and thus merely in the region of the central plane 374, such that likewise no tilting moment acts on the drive member 246 as a result of the coupling journal 292.

It is thus ensured in this exemplary embodiment that, even if tilting moments occur in the region of the driveshaft 228 and should be transmitted by the eccentric drive journal 244, and even if tilting moments occur by the guide body 254 with the orbital path balancing mass 252 and should be transmitted by the coupling journal 292, the rotary bearing 248 can rotate substantially freely of tilting moments of this kind and therefore does not experience any reduction to its service life caused by tilting moments.

The invention claimed is:

1. A compressor, comprising;

a compressor housing, a scroll compressor unit which is arranged in the compressor housing and comprises a first stationary compressor body with first scroll ribs, and a second compressor body with second scroll ribs, the second compressor body movable relative to the first stationary compressor body, the first and second scroll ribs of which are each formed as an involute of a circle, engage with one another and form compressor chambers when the second compressor body is moved, relative to the first stationary compressor body, on an orbital path;

an axial guide which supports the second compressor body in respect of movements in a direction parallel to a central axis of the first stationary compressor body and guides the second compressor body in the event of movements in a direction transverse to the central axis;

an eccentric drive for the scroll compressor unit, said eccentric drive having a drive member which is driven by a drive motor and which revolves about a central axis of a driveshaft on the orbital path and which cooperates with a drive member receptacle of the second compressor body;

an orbital path balancing mass which counteracts an unbalance due to the second compressor body moving on the orbital path, and a coupling preventing the second compressor body from rotating;

wherein the orbital path balancing mass is coupled to the eccentric drive such that said orbital path balancing mass moves on the orbital path in a manner corresponding to the movement of the drive member but is uncoupled with respect to a transmission of tilting moments to the drive member;

wherein the orbital path balancing mass is guided on the driveshaft by means of a guide body cooperating with the driveshaft;

wherein the guide body is guided relative to the driveshaft by an axial guide; and wherein the axial guide holds a guide face of the guide body in abutment against an alignment face of the driveshaft.

2. A compressor according to claim 1, wherein the orbital path balancing mass is guided by the guide body engaging with the driveshaft on a path which runs in a path plane which runs parallel to an alignment plane running perpendicularly to the central axis of the driveshaft.

3. A compressor according to claim 1, wherein the guide body is plate-shaped.

4. A compressor according to claim 1, wherein the axial guide comprises an element acting on the guide body on a side opposite a guide face.

5. A compressor according to claim 4, wherein the element is a retaining ring fixed relative to the driveshaft.

6. A compressor according to claim 4, wherein the element is a projection arranged on the eccentric drive journal.

7. A compressor according to claim 1, wherein the guide body is rotatable relative to an eccentric drive journal to a limited extent.

8. A compressor, comprising;

a compressor housing, a scroll compressor unit which is arranged in the compressor housing and comprises a first stationary compressor body with first scroll ribs, and a second compressor body with second scroll ribs, the second compressor body movable relative to the first stationary compressor body, the first and second scroll ribs of which are each formed as an involute of a circle, engage with one another and form compressor chambers when the second compressor body is moved, relative to the first stationary compressor body, on an orbital path;

an axial guide which supports the second compressor body in respect of movements in a direction parallel to a central axis of the first stationary compressor body and guides the second compressor body in the event of movements in a direction transverse to the central axis;

an eccentric drive for the scroll compressor unit, said eccentric drive having a drive member which is driven by a drive motor and which revolves about a central axis of a driveshaft on the orbital path and which cooperates with a drive member receptacle of the second compressor body;

an orbital path balancing mass which counteracts an unbalance due to the second compressor body moving on the orbital path, and a coupling preventing the second compressor body from rotating;

wherein the orbital path balancing mass is coupled to the eccentric drive such that said orbital path balancing mass moves on the orbital path in a manner corresponding to the movement of the drive member but is uncoupled with respect to a transmission of tilting moments to the drive member;

wherein the orbital path balancing mass is guided on the driveshaft by means of a guide body cooperating with the driveshaft;

wherein the guide body is guided relative to the driveshaft by an axial guide;

wherein the axial guide comprises an element acting on the guide body on a side opposite the guide face; and wherein the element is a screw head of a screw engaging in the driveshaft.

9. A compressor, comprising;

a compressor housing, a scroll compressor unit which is arranged in the compressor housing and comprises a first stationary compressor body with first scroll ribs, and a second compressor body with second scroll ribs, the second compressor body movable relative to the first stationary compressor body, the first and second scroll ribs of which are each formed as an involute of a circle, engage with one another and form compressor chambers when the second compressor body is moved, relative to the first stationary compressor body, on an orbital path;

an axial guide which supports the second compressor body in respect of movements in a direction parallel to a central axis of the first stationary compressor body and guides the second compressor body in the event of movements in a direction transverse to the central axis;

an eccentric drive for the scroll compressor unit, said eccentric drive having a drive member which is driven by a drive motor and which revolves about a central axis of a driveshaft on the orbital path and which cooperates with a drive member receptacle of the second compressor body;

an orbital path balancing mass which counteracts an unbalance due to the second compressor body moving on the orbital path, and a coupling preventing the second compressor body from rotating;

wherein the orbital path balancing mass is coupled to the eccentric drive such that said orbital path balancing mass moves on the orbital path in a manner corresponding to the movement of the drive member but is uncoupled with respect to a transmission of tilting moments to the drive member;

wherein the orbital path balancing mass is guided on the driveshaft by means of a guide body cooperating with the driveshaft;

wherein the guide body is rotatable relative to an eccentric drive journal to a limited extent; and wherein a first movement limiting unit is effective between the driveshaft and the guide body.

10. A compressor according to claim 9, wherein the guide body is guided by means of a guide face at an alignment face of the driveshaft.

11. A compressor according to claim 10, wherein the alignment face provided on the driveshaft is an end face of the driveshaft.

12. A compressor according to claim 10, wherein the guide body is arranged in a manner extending beyond the alignment face.

13. A compressor according to claim 10, wherein the guide body is arranged between the alignment face of the driveshaft and the drive member.

14. A compressor according to claim 9, wherein the first movement limiting unit allows a free rotatability of the guide body relative to the driveshaft in the range of from 0.5° (angle degrees) to 5° (angle degrees).

15. A compressor according to claim 9, wherein the first movement limiting unit is formed by a stop body held on the guide body or the driveshaft and a recess receiving the stop body and arranged on the driveshaft or the guide body respectively.

16. A compressor, comprising;

a compressor housing, a scroll compressor unit which is arranged in the compressor housing and comprises a first stationary compressor body with first scroll ribs, and a second compressor body with second scroll ribs, the second compressor body movable relative to the first stationary compressor body, the first and second scroll ribs of which are each formed as an involute of a circle, engage with one another and form compressor chambers when the second compressor body is moved, relative to the first stationary compressor body, on an orbital path;

an axial guide which supports the second compressor body in respect of movements in a direction parallel to a central axis of the first stationary compressor body and guides the second compressor body in the event of movements in a direction transverse to the central axis;

an eccentric drive for the scroll compressor unit, said eccentric drive having a drive member which is driven by a drive motor and which revolves about a central axis of a driveshaft on the orbital path and which cooperates with a drive member receptacle of the second compressor body;

an orbital path balancing mass which counteracts an unbalance due to the second compressor body moving on the orbital path, and a coupling preventing the second compressor body from rotating;

wherein the orbital path balancing mass is coupled to the eccentric drive such that said orbital path balancing mass moves on the orbital path in a manner corresponding to the movement of the drive member but is uncoupled with respect to a transmission of tilting moments to the drive member;

wherein the orbital path balancing mass is guided on the driveshaft by means of a guide body cooperating with the driveshaft; and wherein a first movement limiting unit is effective between the driveshaft and the guide body and allows a limited free rotatability of the guide body about an eccentric journal axis.

17. A compressor according to claim 16, wherein the guide body is fixedly connected to the orbital path balancing mass.

18. A compressor according to claim 16, wherein the eccentric drive journal passes through a journal receptacle in the guide body.

19. A compressor according to claim 16, wherein the orbital path balancing mass is arranged symmetrically with respect to a mass balancing plane which runs through the central axis of the driveshaft and through the central axis of the second compressor body.

20. A compressor according to claim 19, wherein the orbital path balancing mass is arranged on a side, opposite an eccentric drive journal, of a geometric transverse plane running perpendicularly to the mass balancing plane and through the central axis of the driveshaft.

21. A compressor, comprising:

a compressor housing;

a scroll compressor unit which is arranged in the compressor housing and comprises a first stationary compressor body with first scroll ribs, and a second compressor body with second scroll ribs, the second compressor body movable relative to the first stationary compressor body, the first and second scroll ribs of which are each formed as an involute of a circle, engage with one another and form compressor chambers when the second compressor body is moved, relative to the first stationary compressor body, on an orbital path;

an axial guide which supports the second compressor body in respect of movements in a direction parallel to a central axis of the first stationary compressor body and guides the second compressor body in the event of movements in a direction transverse to the central axis;

an eccentric drive for the scroll compressor unit, said eccentric drive having a drive member which is driven by a drive motor and which revolves about a central axis of a driveshaft on the orbital path and which cooperates with a drive member receptacle of the second compressor body;

an orbital path balancing mass which counteracts an unbalance due to the second compressor body moving on the orbital path; and a coupling preventing the second compressor body from rotating;

wherein the eccentric drive comprises an eccentric drive journal driving the drive member and comprises a coupling body that couples the orbital path balancing mass to the drive member;

wherein the coupling body is also a mass balancing body; and wherein the coupling body has a mass which differs at most by 20% from the mass of the eccentric drive journal.

22. A compressor according to claim 21, wherein the orbital path balancing mass is guided on the orbital path by an eccentric drive journal acting between the drive member and the driveshaft.

23. A compressor according to claim 21, wherein the coupling body is effective between a guide body and the drive member.

24. A compressor according to claim 21, wherein the coupling body is arranged fixedly on either of a guide body or drive member and engages in a recess in the other of the guide body or drive member.

25. A compressor according to claim 24, wherein the coupling body is arranged in the recess with play.

26. A compressor according to claim 21, wherein the coupling body is configured as a coupling journal.

27. A compressor according to claim 21, wherein the eccentric drive journal and the coupling body are arranged on mutually opposed sides of a mass balancing plane.

28. A compressor according to claim 27, wherein the mass balancing plane runs through the central axis of the driveshaft and the central axis of the second compressor body movable in an orbiting manner.

29. A compressor according to claim 21, wherein the coupling body is configured as a mass balancing journal.

30. A compressor according to claim 21, wherein the driveshaft has a portion facing away from the scroll compressing unit, which portion carries an unbalance compensation mass facing away from the scroll compressing unit.

31. A compressor according to claim 30, wherein the unbalance compensation mass facing away from the compressor is arranged between a rotor of the drive motor and a rear bearing unit of the driveshaft.

32. A compressor, comprising:

a compressor housing;

a scroll compressor unit which is arranged in the compressor housing and comprises a first stationary compressor body with first scroll ribs, and a second compressor body with second scroll ribs, the second compressor body movable relative to the first stationary compressor body, the first and second scroll ribs of which are each formed as an involute of a circle, engage with one another and form compressor chambers when the second compressor body is moved, relative to the first stationary compressor body, on an orbital path;

an axial guide which supports the second compressor body in respect of movements in a direction parallel to a central axis of the first stationary compressor body and guides the second compressor body in the event of movements in a direction transverse to the central axis;

an eccentric drive for the scroll compressor unit, said eccentric drive having a drive member which is driven by a drive motor and which revolves about a central axis of a driveshaft on the orbital path and which cooperates with a drive member receptacle of the second compressor body;

an orbital path balancing mass which counteracts an unbalance due to the second compressor body moving on the orbital path; and a coupling preventing the second compressor body from rotating;

wherein the eccentric drive comprises an eccentric drive journal driving the drive member and comprises a coupling body that couples the orbital path balancing mass to the drive member;

wherein the coupling body is also a mass balancing body; and wherein the coupling body has substantially the same mass as the eccentric drive journal.

33. A compressor, comprising:

a compressor housing;

a scroll compressor unit which is arranged in the compressor housing and comprises a first stationary compressor body with first scroll ribs, and a second compressor body with second scroll ribs, the second compressor body movable relative to the first stationary compressor body, the first and second scroll ribs of which are each formed as an involute of a circle, engage with one another and form compressor chambers when the second compressor body is moved, relative to the first stationary compressor body, on an orbital path;

an axial guide which supports the second compressor body in respect of movements in a direction parallel to a central axis of the first stationary compressor body and guides the second compressor body in the event of movements in a direction transverse to the central axis;

an eccentric drive for the scroll compressor unit, said eccentric drive having a drive member which is driven by a drive motor and which revolves about a central axis of a driveshaft on the orbital path and which cooperates with a drive member receptacle of the second compressor body;

an orbital path balancing mass which counteracts an unbalance due to the second compressor body moving on the orbital path; and a coupling preventing the second compressor body from rotating;

wherein the eccentric drive comprises an eccentric drive journal driving the drive member and comprises a coupling body that couples the orbital path balancing mass to the drive member;

wherein the coupling body is also a mass balancing body;

wherein the coupling body is configured as a mass balancing journal; and wherein a journal axis of the mass balancing journal is arranged at the same spacing from a mass balancing plane as an eccentric journal axis of the eccentric drive journal.

34. A compressor according to claim 33, wherein the journal axis of the mass balancing journal runs substantially parallel to the eccentric drive axis of the eccentric drive journal.

35. A compressor according to claim 33, wherein a journal axis of the mass balancing journal and the eccentric journal axis of the eccentric drive journal run parallel to the mass balancing plane.

36. A compressor according to claim 33, wherein the orbital path balancing mass is arranged on a side, opposite the eccentric drive journal and the mass balancing body, of a geometric transverse plane running perpendicularly to the mass balancing plane and through the central axis of the driveshaft.

37. A compressor according to claim 33, wherein the driveshaft has a portion facing the compressor, which portion carries an unbalance compensation mass facing the compressor and carries the eccentric drive journal and in particular guides the mass balancing body and the orbital path balancing mass.

38. A compressor according to claim 37, wherein the unbalance compensation mass facing the compressor is arranged on the driveshaft between a rotor of the drive motor and a front bearing unit.

* * * * *